US007946360B2

(12) United States Patent
Orban et al.

(10) Patent No.: US 7,946,360 B2
(45) Date of Patent: May 24, 2011

(54) DOWNHOLE DRILLING OF A LATERAL HOLE

(75) Inventors: Jacques Orban, Clamart Cedex (FR); Spyro Kotsonis, Le Plessis Robinson (FR); Jo Acquaviva, Paris (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 666 days.

(21) Appl. No.: 10/597,341

(22) PCT Filed: Jan. 26, 2005

(86) PCT No.: PCT/EP2005/000930

§ 371 (c)(1),
(2), (4) Date: Jul. 17, 2008

(87) PCT Pub. No.: WO2005/071208

PCT Pub. Date: Aug. 4, 2005

(65) Prior Publication Data

US 2008/0277166 A1 Nov. 13, 2008

(30) Foreign Application Priority Data

Jan. 27, 2004 (EP) ..... 04290201

(51) Int. Cl.
*E21B 7/04* (2006.01)

(52) U.S. Cl. ..... 175/61; 175/321

(58) Field of Classification Search ..... 175/61, 175/321

See application file for complete search history.

(56) References Cited

U.S. PATENT DOCUMENTS

| | | | | |
|---|---|---|---|---|
| 3,225,843 | A * | 12/1965 | Ortloff et al. | 175/93 |
| 3,586,116 | A | 6/1971 | Rouviere et al. | |
| 3,888,319 | A | 6/1975 | Bourne, Jr. et al. | |
| 4,281,723 | A | 8/1981 | Edmond et al. | |
| 4,463,814 | A * | 8/1984 | Horstmeyer et al. | 175/45 |
| 4,616,719 | A | 10/1986 | Dismukes | |
| 5,215,151 | A * | 6/1993 | Smith et al. | 175/45 |
| 5,311,952 | A * | 5/1994 | Eddison et al. | 175/61 |
| 5,316,094 | A * | 5/1994 | Pringle | 175/74 |
| 5,394,951 | A | 3/1995 | Pringle et al. | |
| 6,305,469 | B1 | 10/2001 | Maekiho et al. | |

FOREIGN PATENT DOCUMENTS

WO WO99/29997 6/1999

* cited by examiner

*Primary Examiner* — Hoang Dang
(74) *Attorney, Agent, or Firm* — Matthias Abrell; Myron K. Stout

(57) ABSTRACT

A system for drilling a lateral hole departing from a main well. The system comprises a motor assembly (415) including a motor (412) to generate a rotating torque, an axial thruster (411) to generate an axial force, a blocking system (410) to fix the motor and the axial thruster downhole. The motor assembly further includes a drive shaft (414) to transmit the rotating torque. The system further comprises a first and second connector (402, 404) for transmitting the rotating torque and the axial force from the motor assembly to a drill string assembly. The first connector is connectable to the drill string assembly so as to transmit the axial force only to the drill pipe (401), and to transmit the rotating torque to a further drive (405) shaft positioned within the drill pipe. The second connector (402) is connectable to the drill string assembly so as to transmit both the axial force and the rotating torque to the drill pipe (401).

49 Claims, 20 Drawing Sheets

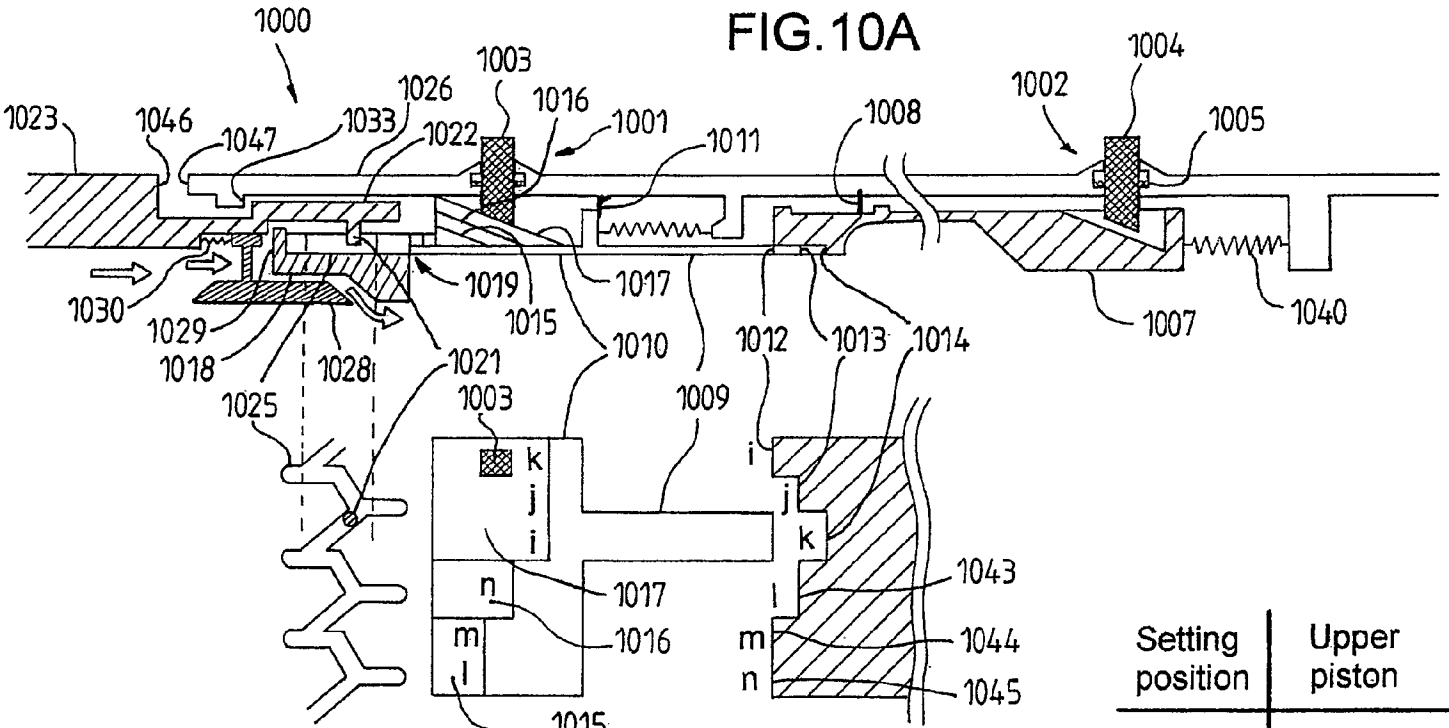
FIG.10A
| Setting position | Upper piston | Lower piston |
|---|---|---|
| i | extended | extended |
| j | extended | middle |
| k | extended | retracted |
| l | retracted | middle |
| m | retracted | extended |
| n | middle | extended |
FIG.10E
FIG.10C
FIG.10D
FIG.10F
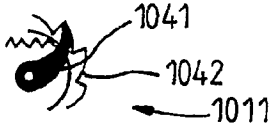
FIG.10B

DOWNHOLE DRILLING OF A LATERAL HOLE

BACKGROUND OF INVENTION

1. Field of the Invention

The invention relates generally to the drilling of a lateral hole from a main well.

2. Background Art

Lateral hole drilling has become a new drilling method to construct a well. With the lateral hole drilling allows to access an extra zone of an underground reservoir, e.g. an hydrocarbon reservoir, or an aquifer. The lateral hole drilling method is proven to be useful in the case of high hydrocarbon viscosity, low permeability formation, highly layered reservoir etc. The lateral hole drilling method also enables to reach a reservoir when drilling slots are limited, like for example with an off-shore platform.

A drilling rig is commonly used to drill the lateral hole departing from a main well. A rotating torque is generated at surface and is transmitted to a drill string downhole. The rotating torque may also be generated downhole by an hydraulic converter while a pump is used at surface. An axial force to be applied on a drill bit at an end of the drill string may be generated by the weight of the drill string along a vertical or diagonal portion of the main well.

A coiled tubing may also be employed for drilling the lateral hole. An injection head pushes a coiled tubing into the main well. Several tools, typically a drill collar, an orienting tool, a steerable motor and a drill bit, may be located at an end of the coiled tubing. A rotating torque and an axial force are applied on the drill bit. The rotating torque is generated by an hydraulic converter of the steerable motor while a pump is used at surface. The axial force may be generated by the weight of the tools, or even of the coiled tubing. The axial force may also be generated at surface by the injection head.

Several recent systems for drilling small lateral holes generate the rotating torque downhole with an electrical motor. In most cases, the drilling of the lateral hole is performed in two steps. During a first step, a short radius curved hole is drilled using a first drilling system. When a desired direction is reached, the first drilling system is removed out of the lateral hole and a second drilling system drills the lateral hole substantially following the determined direction.

The first drilling system may be a steerable motor that is bent so as to allow to drill following a curve.

Steerable Motor

FIG. 1 illustrates a schematic of a steerable motor according to prior art. The steerable motor 101 comprises a drill pipe 105, a transmission shaft 103 to which a drill bit 107 is connected. The drill pipe 105 is bent so as to allow to drill a curved hole. During the drilling, the steerable motor 101 is forced against a bottom wall of the drilled hole: a command radius of the curved hole is determined by relative positions of three contact points 102.

In case of a soft formation, it may happen that the steerable motor 101 drills a bore having a relatively large section. A resulting curved hole may hence have an effective radius that is higher than the command radius. In order to control the effective radius, the contact points 102 may be provided at locations corresponding to a relatively small command radius. The steerable motor 101 may be employed with either an angled mode or a straight mode.

In the angled mode, an hydraulic converter 104, e.g. a progressive cavity motor, located in the steerable motor rotates the transmission shaft 103 using a circulation of a drilling fluid (not represented). The drilling bit 107 is hence rotated. The drill pipe 105 remains at a same azimuthal position and transmits an axial force. The lower part of the transmission shaft 103 is supported by bearings 106 to transmit the axial force from the drill pipe 105 to the drill bit 107. As a result, the resulting curved hole is bent with an effective radius greater or equal to the command radius.

If the effective radius is smaller than a desired radius, the steerable motor 101 may be used in a straight mode, i.e., the drill pipe 105 itself is rotated. The bent angle fails to point in a preferred direction, and a large hole having a substantially straight direction is drilled. When combined to the angled mode, the straight mode allows to control the effective radius of the curved hole.

Control of a Direction of Drilling

During a drilling, a bottom hole assembly, such as the steerable motor, may comprise stabilizers. The stabilizers allow to position the drill pipe in the hole. The stabilizers also allow to drill in an upward direction, or in a downward direction.

FIG. 2 illustrates a stabilizer from prior art. The stabilizer 202 comprises blades that surrounds a drill string 201 and leans on an internal wall 204 of a drilled hole. Hence the stabilizer 202 maintains a center of the drill string 201 substantially in a center of a section of the drilled hole. The weight of the drill string may cause a deformation of the drill string. The drill string 201 hence allows to drill following a direction that is determined by relative longitudinal positions of the stabilizers and by the weight of the drill string 201.

FIG. 3A illustrates a straight configuration of a bottom hole assembly for drilling a lateral hole according to prior art. A drill bit 303 is located at an end of a drill string 301 of a bottom hole assembly. Three stabilizers (302*a*, 302*b*, 302*c*) surround the drill string 301 at different locations. The stabilizers (302*a*, 302*b*, 302*c*) maintain a center of the drill bit 303 in a center of a section of a drilled hole 304 so as to insure a relatively straight drilling.

FIG. 3B illustrates a drop configuration of a bottom hole assembly for drilling a lateral hole according to prior art. A first stabilizer 302*a* and a second stabilizer 302*b* surround a drill string 301. As the first stabilizer 302*a* and the second stabilizer 302*b* are located at a relatively high distance from a drill bit 303 at an end of the drill string 301, the drill string 301 flexes under its own weight, thus causing the drill bit 303 to drill a hole 304 following a downward direction.

FIG. 3C illustrates a build configuration of a bottom hole assembly for drilling a lateral hole according to prior art. A first stabilizer 302*a* and a second stabilizer 302*c* surround a drill string 301. The first stabilizer 302*a* and the second stabilizer 302*c* are located at a relatively long distance from each other, and the second stabilizer 302*c* is relatively close to a drill bit 303 at an end of the drill string 301. A weight of a portion of the drill string 301 between the stabilizers (302*a*, 302*c*) causes the drill string 301 to flex elastically downward between the stabilizers (302*a*, 302*c*). The drill bit 303 is hence pushed upward and drills in an upward direction.

When a change of direction is required, the drill string needs to be pulled out of the well so as to displace the stabilizers. In order to avoid the pulling out of the drill string, a variable diameter stabilizer may be set. The diameter of the variable diameter stabilizer may be changed from one position to the other. The changing of position involves a mechanical system: only one single different diameter of the variable diameter stabilizer may be set in a bottom hole assembly. The changing of position may be commanded from surface.

A setting of the variable diameter stabilizer is typically controlled by mechanical and flow events, e.g. an applying of an axial force, a removal of a rotating torque, an applying of a flow of a flow, a pressure drop due to the applying of the flow etc. A chronological order of the mechanical and flow events allows to set a proper stabilizer position. For example, the mechanical system typically comprises a key that may slide within an internal slot along a periphery of the bottom hole assembly. The key may slide between an upward position and a downward position depending on the chronological order of the mechanical and flow events. When the key is in the upward position, a transmission system allows a blade of the variable diameter stabilizer to be retracted. When the key is in the downward position, the transmission system pushes the blade against a wall of the drilled hole. The transmission system may be a shaft indirectly connected to the blade, or an inside tubing that is cone-shaped.

It is hence possible to decide from the surface if the drilling is performed following a straight direction or an other direction. The other direction may be an upward direction, or a downward direction, depending on a relative longitudinal position of the variable diameter stabilizer.

A bottom hole assembly with a variable diameter stabilizer may comprise three stabilizers as represented in FIG. 3A, wherein one of the three stabilizers is the variable diameter stabilizer. The variable diameter stabilizer may be the closest from the drill bit stabilizer. In this case, a retracting of the diameter of the variable diameter stabilizer provides a configuration that is similar to the one represented in FIG. 3B. It is hence possible to drill following a straight direction or a downward direction, depending on a diameter of the variable diameter stabilizer.

Similarly, the diameter stabilizer may be located between the other stabilizers. In this case, a retracting of the diameter of the variable diameter stabilizer provides a configuration that is similar to the one represented in FIG. 3C. It is hence possible to drill following a straight direction or an upward direction, depending on a diameter of the variable diameter stabilizer.

Monitoring of the Direction of Drilling

Controlling a direction of a drilling of a lateral hole also requires to monitor a drilling direction of a drill bit. Such a monitoring is usually performed by providing a Measurement While Drilling (MWD) tool on a bottom hole assembly. The MWD tool may comprise an accelerometer system and a magnetometer system. The accelerometer system comprises at least one accelerometer. The accelerometer allows a measurement of an inclination of a drill pipe versus the Earth gravity vector. The magnetometer system comprises at least one magnetometer allowing a measurement of an azimuth of the drill pipe versus the Earth magnetic field.

The accelerometer system may comprise three accelerometers allowing to measure three distinct inclinations versus the Earth gravity vector, so as to provide a three dimensions measurement of a position of the drill pipe.

The magnetometer system may comprise three magnetometers allowing to measure three distinct azimuths versus the Earth magnetic field. The MWD tool may also comprise both the three accelerometers and the three magnetometers.

The MWD tool typically communicates with the surface using acoustic telemetry. The MWD tool is typically located at a relatively high distance from the drill bit, e.g. 25 meters. As a consequence of this distance, the MWD provides measurements having a relatively low accuracy, since a curvature of the lateral hole below the MWD is not known.

Very Short Radius Drilling

In a case of a very short radius drilling, it is possible to use a motor that is blocked within a main well and a flexible shaft that may transmit a rotating torque and an axial force to a drill bit. The flexible shaft is bent substantially perpendicularly at an elbow between the main well and a drilled lateral hole. A guide system is provided within the main well so as to allow the transmitting of the rotating torque and the axial force at the elbow.

The guide system may be lubricated so as to diminish contact stresses between the flexible shaft and the whipstock.

The guide system is typically a whipstock.

International application WO99/29997 describes a system in which bushings are used within an elbow for causing a flexible shaft to flex and turn while permitting rotation and axial movement therethrough.

Flow and Cuttings Management

Drilling a hole creates cuttings that need to be processed. This can for example de done as described in the following. A pump at surface injects a drilling fluid, e.g. a drilling mud, through a hollow drilling tool. The drilling fluid reaches a drill bit of the drilling tool and is evacuated through an annulus between the drilling tool and the drilled hole. The drilling fluid is viscous enough to carry the cuttings that are created at the drill bit up to the surface. A shale shaker located at the surface allows to separate the cuttings from the drilling fluid.

SUMMARY OF INVENTION

In a first aspect, the invention provides a system for drilling a lateral hole departing from a main well. The system comprises a motor assembly including a motor to generate a rotating torque, an axial thruster to generate an axial force, a blocking system to fix the motor and the axial thruster downhole. The motor assembly further comprises a drive shaft to transmit the rotating torque. The system further comprises a connector for transmitting the rotating torque and the axial force from the motor assembly to a drill string assembly. The drill string assembly comprises a drill pipe and a drill bit. The connector provides a fluid communication channel between the motor assembly and an inside of the drill pipe. The connector is one of a first connector or a second connector. The first connector is connectable to the drill string assembly so as to transmit the axial force only to the drill pipe, and to transmit the rotating torque to a further drive shaft positioned within the drill pipe. The second connector is connectable to the drill string assembly so as to transmit both the axial force and the rotating torque to the drill pipe.

In a first preferred embodiment, the motor is located within the main well.

In a second preferred embodiment, the system further comprises the drill string assembly. The drill string assembly is connected to the connector. The drill string assembly comprises the drill pipe to transmit the axial force and the further drive shaft to transmit the rotating torque. The further drive shaft is positioned within the drill pipe. The system further comprises the drill bit.

In a third preferred embodiment, a portion of the lateral hole comprises a curved hole having a determined radius of curvature. The drill string assembly comprises three contact points to be in contact with a wall of the drilled lateral hole. The three contact points define a drill pipe angle so as to allow to drill the curved hole.

In a fourth preferred embodiment, the system further comprises a thrust bearing to transmit the axial force from the drill pipe to the drill bit. The drill bit is located at an end of the further drive shaft. The system further comprises a plain bearing system to support a flexion of the further drive shaft within the drill pipe.

In a fifth preferred embodiment, the motor is electrical.

In a sixth preferred embodiment, The system further comprises the drill string assembly. The drill string assembly is connected to the connector. The drill string assembly comprises the drill pipe to transmit both the axial force and the rotating torque. The system further comprises the drill bit.

In a seventh preferred embodiment, the system further comprises at least one variable diameter stabilizer to position the drill bit within a section of the lateral hole. The system further comprises controlling means to mechanically control from a remote location at least one stabilizer parameter among a set of stabilizer parameters. The set of stabilizer parameters comprises a diameter size of a determined variable diameter stabilizer, a distance between a first stabilizer and a mark device inside the lateral hole, the mark device being any one of a distinct stabilizer or a drill bit, a coordinated retracting of at least two variable diameter stabilizers, and a azimuthal radius of the determined variable diameter stabilizer.

In a eighth preferred embodiment, the system further comprises a single control unit to control at least one stabilizer parameter among the set of stabilizer parameters.

In a ninth preferred embodiment, the system comprises a configuration slot and a a configuration plot that may be displaced by the controlling means. The configuration plot allows to select among a set of setting positions a desired setting position. The set of setting positions comprises at least three setting positions. Each setting position corresponds to a determined value of the at least one stabilizer parameter.

In a tenth preferred embodiment, the system further comprises two variable diameter stabilizers that may be set in a coordinated fashion.

In an eleventh preferred embodiment, the system further comprises a Hall Effect sensor to measure a diameter of one of the two variable diameter stabilizers.

In a twelfth preferred embodiment, the system further comprises at least one micro-sensor in a close neighborhood of the drill bit. The at least one nicro-sensor allows a measurement of an orientation of the drill bit relative to a reference direction.

In a thirteenth preferred embodiment, the drill pipe is flexible, so as to allow a bending while transmitting the rotating torque and the axial force. The system further comprises a bending guide with rotating supports to support the drill pipe at the bend.

In a fourteenth preferred embodiment, the rotating supports are belts being supported by a pulley.

In a fifteenth preferred embodiment, the system further comprises a pump located downhole to pump a drilling fluid.

In a sixteenth preferred embodiment, the drilling fluid may circulate from the main well to the drill bit through an annulus between the drilled lateral hole and the drill string assembly. The drilling fluid may circulate from the drill bit to the main well through the fluid communication channel.

In a seventeenth preferred embodiment, the drill bit comprises a bit hole allowing to evacuate cuttings generated at the drill bit through the drill bit. The drill bit comprises a main blade to insure a cutting action.

In an eighteenth preferred embodiment, the system further comprises a passage located at an output of the lateral hole. The passage allows to guide a flow of drilling fluid from the lateral hole into the main well.

In a nineteenth preferred embodiment, the system further comprises a sealing device to force the drilling fluid to circulate through the passage.

In a twentieth preferred embodiment, the passage is oriented downward.

In a twenty-first preferred embodiment, the system further comprises a filter device for separating cuttings from the drilling fluid. The filter device is located downhole.

In a twenty-second preferred embodiment, the system further comprises a compactor within the filter device to regularly provide a compaction of the filtered cuttings.

In a twenty-third preferred embodiment, the system further comprises an adaptive system within the filter device to sort the filtered cutting depending on their size so as to avoid the filtered cuttings to cork the filter device.

In a twenty-fourth preferred embodiment, the system further comprises a container within the main well to collect cuttings below the lateral hole.

In a twenty-fifth preferred embodiment, the system further comprises a cuttings collector unit comprising an housing and a screw to pull the cuttings into the housing.

In a twenty-sixth preferred embodiment, the system further comprises a surface pump to generate a secondary circulation flow along a tubing. The secondary circulation flow allows to carry to the surface cuttings generated at the drill bit and carried by a primary circulation flow from the drill bit to the secondary circulation flow.

In a twenty-seventh preferred embodiment, the system further comprises a flow guide allowing the primary circulation flow to circulate at a relatively high flow velocity between the lateral hole and the tubing so as to avoid a sedimentation of the cuttings.

In a twenty-eighth preferred embodiment, the motor is located within the drilled lateral hole.

In a second aspect, the invention provides a method a method for drilling a lateral hole departing from a main well. The method comprises blocking a motor and an axial thruster downhole. The motor and the axial thruster respectively allow to generate a rotating torque and an axial force. A connector for transmitting the rotating torque and the axial force from a motor assembly to a drill string assembly is provided. The motor assembly includes the motor, the axial thruster and a drive shaft. The drill string assembly includes a drill pipe and a drill bit. The connector provides a fluid communication channel between the motor assembly and the inside of the drill pipe. The connector is either one of a first connector or a second connector. The first connector is connectable to the drill string assembly so as to transmit the axial force only to the drill pipe, and to transmit the rotating torque to a further drive shaft positioned within the drill pipe. The second connector is connectable to the drill string assembly so as to transmit both the axial force and the rotating torque to the drill pipe.

In a twenty-ninth preferred embodiment, the drill pipe transmits the axial force, and the further drive shaft transmits the rotating torque to the drill bit.

In a thirtieth preferred embodiment, the method further comprises controlling an effective radius of a curved hole of the lateral hole. The controlling is performed by combining an angled mode to a straight mode. During the angled mode, three contacts points of the drill string assembly are in contact with a wall of the drilled lateral hole so as to allow to drill the curved hole. During the straight mode, the following steps are performed: rotating the drill pipe of a first angle, transmitting the rotating torque and the axial force to the drill bit for a first determined duration, pulling the drill string assembly back over a determined distance, rotating the drill pipe of a second angle, transmitting the rotating torque and the axial force to the drill bit for a second determined duration.

In a thirty-first preferred embodiment, the controlling is performed by combining the angled mode and the straight mode to a jetting mode. The jetting mode comprises providing a jet to preferentially erode a formation in a determined direction.

In a thirty-second preferred embodiment, the drill pipe transmits both the rotating torque and the axial force to the drill bit.

In a thirty-third preferred embodiment, the method further comprises mechanically controlling from a remote location at least one stabilizer parameter among a set of stabilizer parameters. The set of stabilizer parameters comprises a diameter size of a determined variable diameter stabilizer, a distance between a first stabilizer relative to a mark device, the mark device being any one of a distinct stabilizer or a drill bit, a retracting of at least two variable diameter stabilizers, and an azimuthal radius of the determined variable diameter stabilizer.

In a thirty-fourth preferred embodiment, the method further comprises displacing a configuration plot within a configuration slot, so as to select a desired setting position among a set of setting positions comprising at least three setting positions. Each setting position corresponds to a determined value of the at least one stabilizer parameter.

In a thirty-fifth preferred embodiment, the drill pipe is flexible, so as to allow a bending while transmitting the rotating torque and the axial force. The drill pipe is supported at the bend by a bending guide comprising rotating supports.

In a thirty-sixth preferred embodiment, the method further comprises monitoring an orientation of a drill bit relative to at least one reference direction with at least one micro sensor located in a close neighbourhood of the drill bit.

In a thirty-seventh preferred embodiment, the method further comprises generating a circulation of a drilling fluid to the drill bit with a pump located downhole.

In a thirty-eighth preferred embodiment, the drilling fluid circulates to the drill bit through an annulus between the drilled lateral hole and the drill string assembly. The drilling fluid circulates from the drill bit through the fluid communication channel.

In a thirty-ninth preferred embodiment, the method further comprises guiding the drilling fluid at an output of the lateral hole through a passage having a predetermined orientation.

In a fortieth preferred embodiment, the drilling fluid is guided downward.

In a forty-first preferred embodiment, the method further comprises downhole filtering cuttings from the drilling fluid.

In a forty-second preferred embodiment, the filtered cuttings are compacted inside a filter device.

In a forty-third preferred embodiment, the filtered cutting are sorted according to their size so as to avoid the filtered cuttings to cork the filter device.

In a forty-fourth preferred embodiment, the method further comprises collecting cuttings downhole at a location below the lateral hole.

In a forty-fifth preferred embodiment, a secondary circulation flow along a tubing is generated. The secondary circulation flow allows to carry to the surface cuttings generated at the drill bit and carried by a primary circulation flow from the drill bit to the secondary circulation flow.

Other aspects and advantages of the invention will be apparent from the following description and the appended claims.

BRIEF DESCRIPTION OF DRAWINGS

FIG. 10A illustrates a cross section of a third possible system according to a third embodiment of the present invention.

FIG. 10B illustrates an example of a ratchet system of a third possible system according to the third embodiment of the present invention.

FIG. 10C illustrates an example of a lower controlling sleeve of a third possible system according to the third embodiment of the present invention.

FIG. 10D illustrates an example of an upper controlling sleeve of a third possible system according to the third embodiment of the present invention.

FIG. 10E illustrates a setting table of a third possible system illustrated in FIG. 10A.

FIG. 10F illustrates an example of a J-slot of a third possible system according to the third embodiment of the present invention.

DETAILED DESCRIPTION

Figure 4:
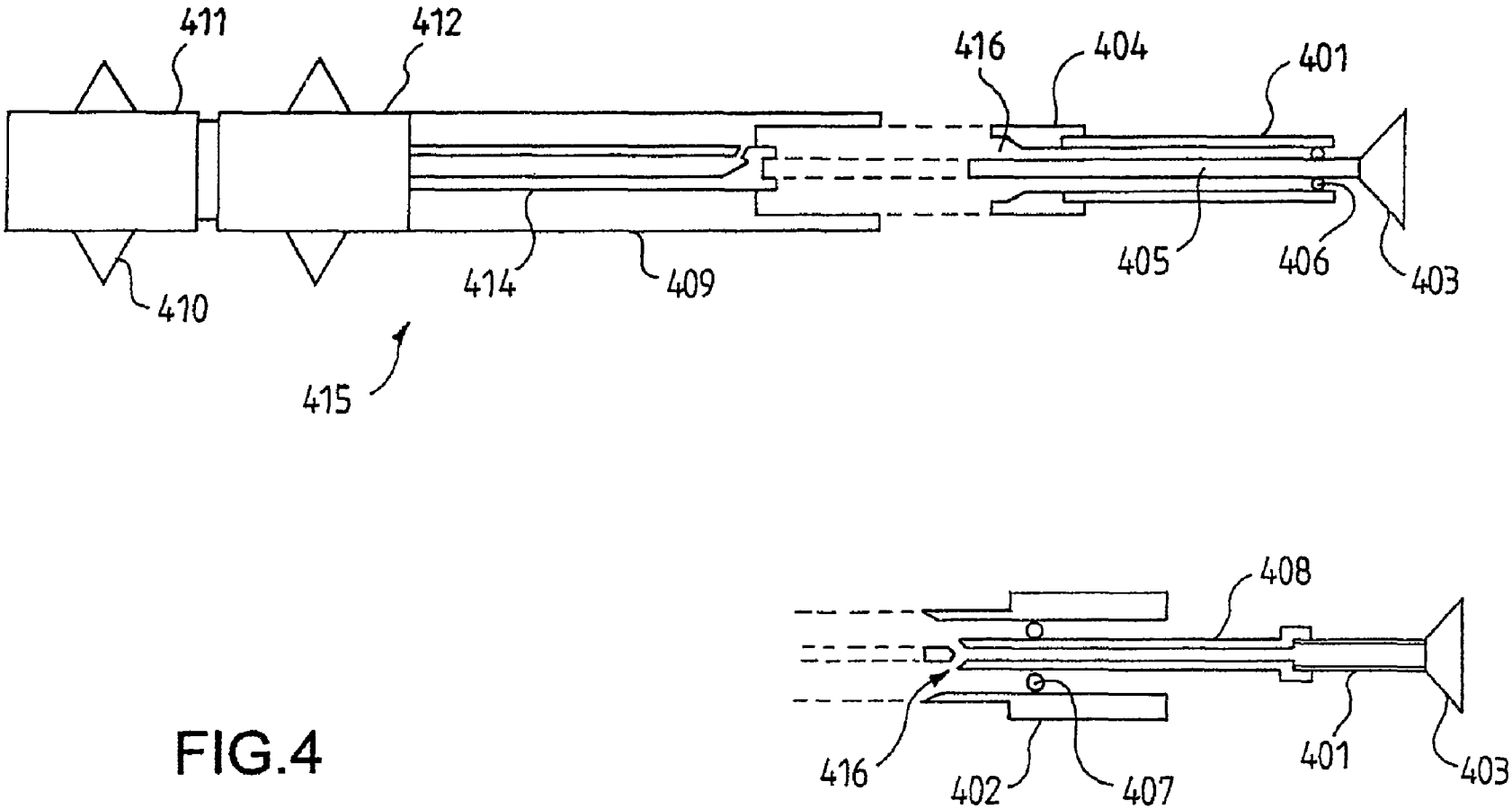
FIG. 4 shows an illustration of an example of a system for drilling a lateral hole according to a first embodiment of the present invention.

FIG. 4 illustrates an example of a system for drilling a lateral hole according to a first embodiment of the present invention. The system comprises a motor assembly 415, which discloses a motor 412 to generate a rotating torque, an axial thruster 411 to generate an axial force, a blocking system 410 to fix the motor 412 and the axial thruster 411 downhole, and a drive shaft 414 to transmit the rotating torque. The system further comprises a connector (402, 404) for transmitting the rotating torque and the axial force from the motor assembly 415 to a drill string assembly. The drill string assembly includes a drill pipe 401 and a drill bit 403.

The connector provides a fluid communication channel 416 between the motor assembly 415 and the inside of the drill pipe 401. A fluid may be moved through the fluid communication channel 416 by a pump (not represented on FIG. 4) driven by a second motor (not represented on FIG. 4). The pump and the second motor are typically installed above the motor 412.

In a first alternative, the connector may be a first connector 404 connectable to the drill string assembly so as to transmit the axial force to the drill pipe 401 only. When the first connector 404 is used, the rotating torque generated at the motor 412 is transmitted to a further drive shaft 405 positioned within the drill pipe. The axial force may be transmitted to the drill bit 403 with axial bearings 406. The first connector 404 may be connected to a housing 409 of the motor assembly 415. A drilling fluid may circulate within the drill string assembly through an annulus between the further drive shaft 405 and the drill pipe 401. Such a dual transmission configuration allows to drill a curved hole: the drill pipe 401 may support bending stresses relatively easily since the rotating torque is transmitted by the further drive shaft 405.

In a second alternative the connector may be a second connector 402 connectable to the drill string assembly. The second connector 402 allows to transmit both the axial force and the rotating torque to the drill pipe 401. The transmitting of the axial force to the drill pipe 401 may be performed using axial bearings 407 and an intermediate pipe 408. Such a rotary transmission configuration is particularly adapted for drilling following a straight direction: in a curved drilled hole, the rotating drill pipe may contact walls of the drilled lateral hole or of a main well, thus reducing the efficiency of the drilling. The second connector 402 may be connected to a housing 409 of the motor assembly 415. With the rotary transmission configuration, the drilling fluid may circulate within the drill string assembly through the drill pipe 401 and through the intermediate pipe 408.

The system according to the invention comprises a motor 412 that is blocked downhole. The transmitting of the rotating torque and the axial force to the drill bit 403 may be adapted depending on a drilling objective, typically a desired radius of the hole to be drilled. The system according to the invention may be configured to drill either a curved hole or a straight hole. For a curved hole, the dual transmission configuration is preferably used: the first connector 404 may be connected to the motor assembly 415. For a straight hole, the second connector 402 may be connected to the motor assembly 415. However, the first connector may be used for drilling the straight hole and the second connector 402 for drilling the curved hole. In this latter case, or in a case in which the second connector 402 is used for drilling the straight hole after the curved hole, the rotating drill pipe 401 or the rotating intermediate pipe 408 may be in contact with the walls of the hole. The rotating drill pipe 401 or the rotating intermediate pipe 408 may be bent from the main well to the lateral hole, or within the lateral hole. A fifth embodiment of the present invention described in a further paragraph allows to drill the curved hole with a bent rotating drill pipe.

Preferably, the motor is blocked within the main well whereas the drill bit drills the lateral hole.

Alternatively, the motor is blocked within the lateral hole. A relatively short drill string may be used, which allows to avoid a rotation of the short drill string within a curve section of the drilled hole during a further drilling of the lateral hole.

The transmitting of the rotating torque comprises a transmitting of a rotation combined with a transmitting of a torque.

The blocking system may comprise a first set of lateral arms to allow a blocking of the thruster. The first set of lateral arms is located on an end of the thruster. A second set of lateral arms may be provided close to the drill bit. When the drill bit has a relative displacement of sufficient amplitude, the second set of lateral arms blocks the drill bit. The first set of lateral arms is then closed, so as to unblock the thruster. The thruster may be operated so as to reduce a distance to the drill bit, the first set of lateral arms opened to re-block the thruster and the second set of lateral arms closed. This operation allows to provide the axial force despite an axial displacement of the drill string.

Figure 5:
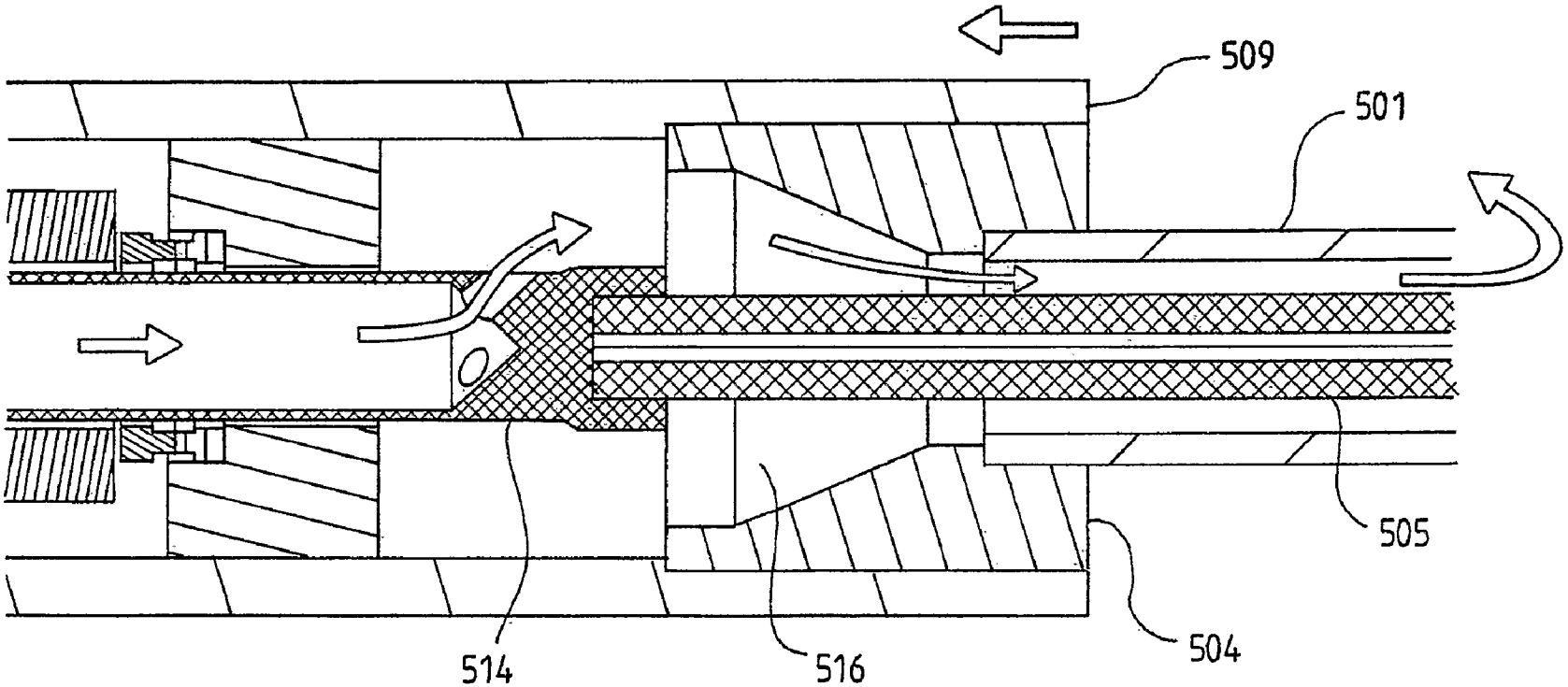
FIG. 5 shows an illustration of an example of a dual transmission configuration of a system for drilling a lateral hole according to the present invention.

FIG. 5 illustrates an example of a dual transmission configuration of a system for drilling a lateral hole according to the invention. Only a portion of the system is represented. A first connector 504 connects a drill pipe 501 to a housing 509.

The housing 509 transmits an axial force generated at a thruster (not represented). The drill pipe 504 hence transmits the axial force to a drill bit (not represented) located at an end of the drill pipe 501.

A rotating torque generated at a motor (not represented) is transmitted by a drive shaft 514 to a further drive shaft 505 at an end of which the drill bit is attached. Both the drive shaft 514 and the further drive shaft 505 are hence rotated. The drive shaft 514 may be guided with bearings (not represented on FIG. 5) held in the housing 509.

The first connector 504 provides a fluid communication channel 516 for a circulating of a drilling fluid. During a drilling operation, the drilling fluid may be pumped through the system. The drilling fluid may circulate through the fluid communication channel 516 to reach the drill bit and evacuated through an annulus between the system and the drilled hole. The large arrows on FIG. 5 represent a possible circulating of the drilling fluid.

Figure 6:
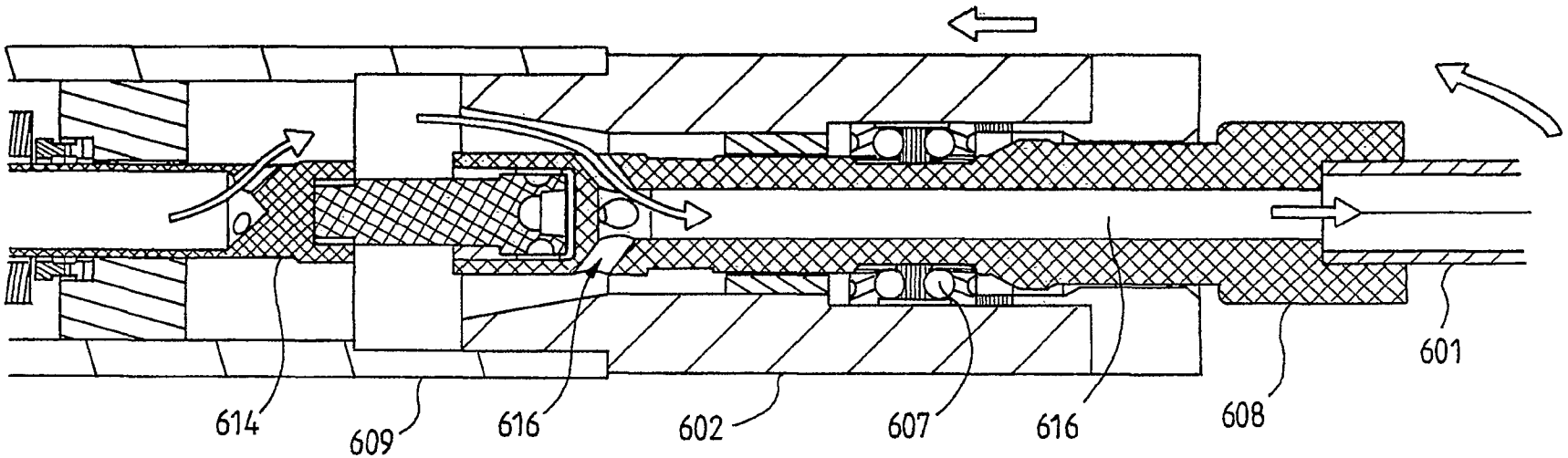
FIG. 6 shows an illustration of an example of a rotary transmission configuration of a system for drilling a lateral hole according to the present invention.

FIG. 6 illustrates an example of a rotary transmission configuration of a system for drilling a lateral hole according to the invention. Only a portion of the system is represented. A second connector 602 connects a drill pipe 601 to a housing 609.

The housing 609 transmits an axial force generated at a thruster (not represented). The second connector 602 transmits the axial force to an intermediate pipe 608 via axial bearings 607. The intermediate pipe 608 transmits the axial force to the drill pipe 601 at an end of which a drill bit (not represented) is attached.

A drive shaft 614 transmits a rotating torque generated at a motor (not represented) to the intermediate pipe 608, and hence to the drill pipe 601. The drive shaft 614, the intermediate pipe 608 and the drill pipe are thus rotated. The drill pipe 601 transmits to the drill bit both the axial force and the rotating torque.

The second connector 602 provides a fluid communication channel 616 for a circulating of a drilling fluid. During a drilling operation, the drilling fluid may be pumped through the system. The drilling fluid may circulate through the fluid communication channel 616, reach the drill bit and be evacuated through an annulus between the system and the drilled hole. The large arrows on FIG. 6 represent a possible circulating of the drilling fluid.

Such a rotary transmission configuration is particularly well adapted for drilling in a straight direction.

The drilling system of the present invention may also be used in a lateral configuration (not represented), wherein the motor is blocked within a lateral hole departing from a main well. In the lateral configuration, the drill string may have a relatively sort length. Both the dual transmission configuration and the rotary transmission configuration may be used. However, the rotary transmission configuration is preferred. A blocking system of the drilling system may comprise extending arms having pads. The pads allow to clamp the drilling machine against walls of the drilled lateral hole. The pads may have a relatively high surface area so as to lower contact stresses.

The drilling system may further comprise a flow channel that allows a drilling fluid to circulate between a drill bit and the main well.

Steerable Device

Figure 1:
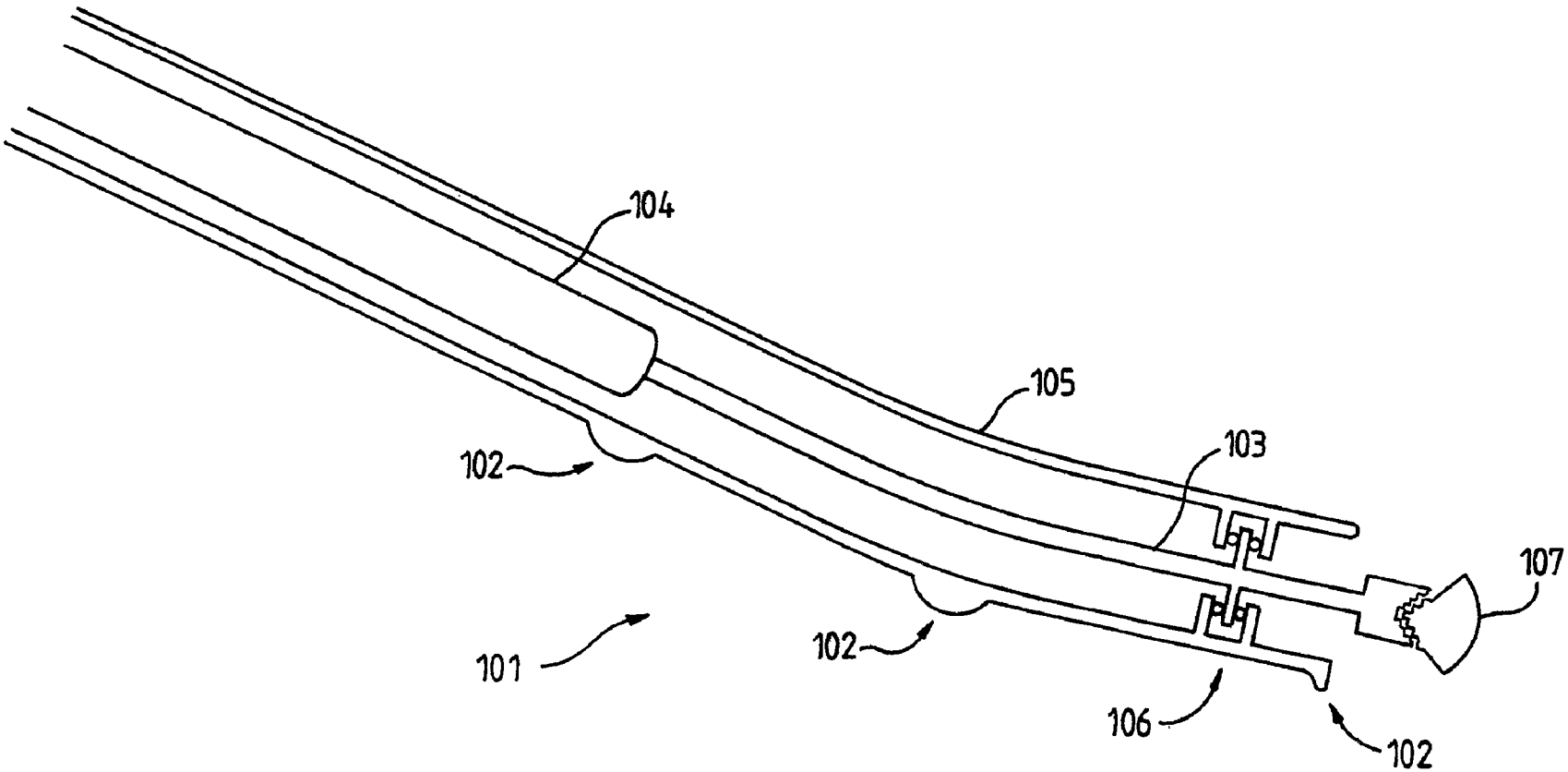
FIG. 1 PRIOR ART
FIG. 1 shows an illustration of a schematic of a steerable motor according to prior art.

A steerable motor as represented in FIG. 1 comprises an hydraulic converter within a drill pipe. The hydraulic converter generates a rotating torque using a circulation of a drilling fluid and is hence relatively long, e.g. 3 meters. The hydraulic converter comprises relatively rigid parts that cannot be bent without damage. The drill pipe of the steerable motor is also relatively long, which prohibits to drill a curved hole having a relatively short radius, e.g. less than 10 meters. There is need for a steerable device allowing to drill a short radius curved hole.

Figure 7:
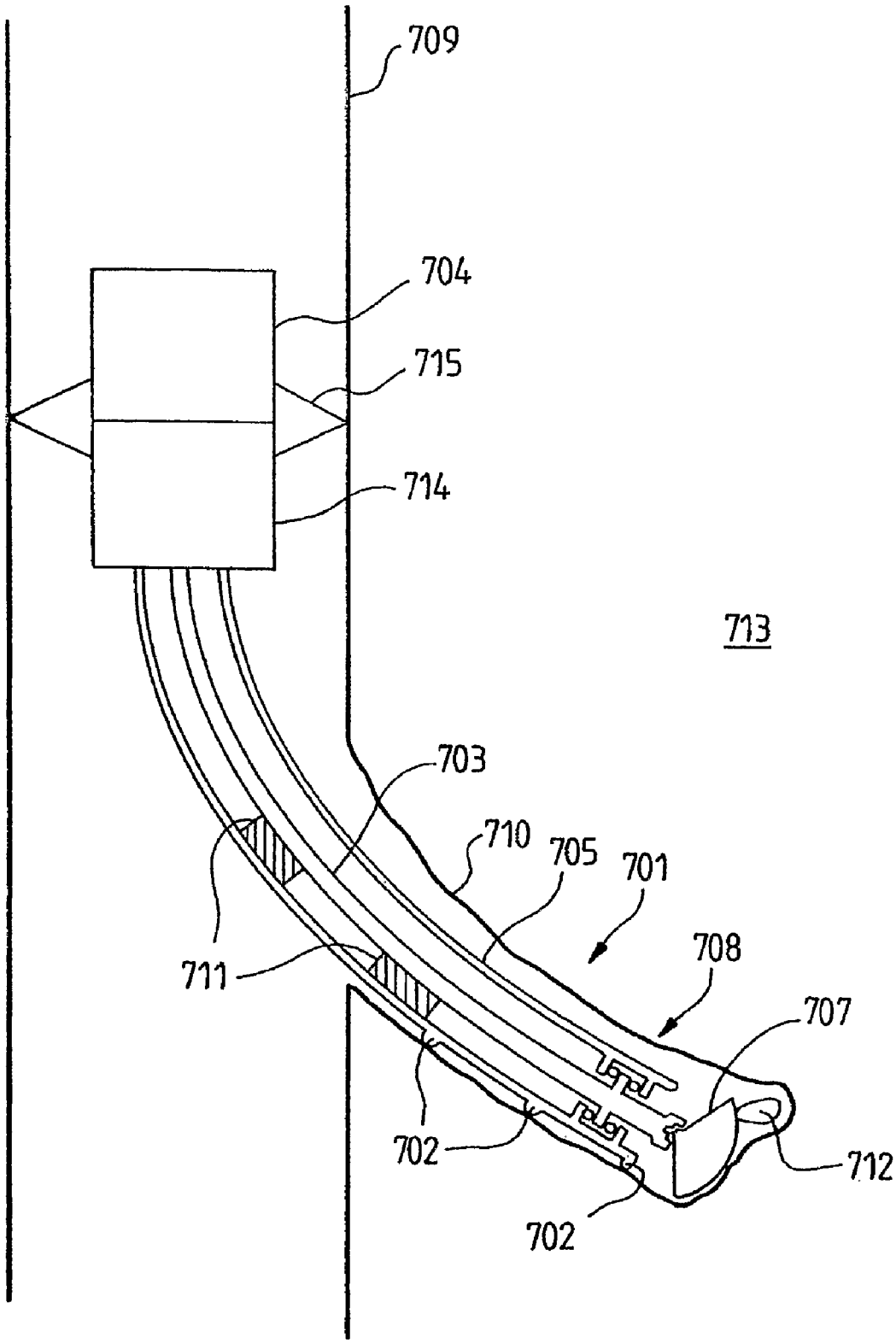
FIG. 7 shows an illustration of an example of a steerable device according to a second embodiment of the present invention.

FIG. 7 illustrates an example of a steerable device according to a second embodiment of the invention. The steerable device 701 comprises a drill pipe 705 that is bent, and a drill bit 707 at an end of the drill pipe 705. The drill bit 707 may be rotated by transmitting a rotating torque. The rotating torque is generated by a motor 704 that is located within the main well 709. As the rotating torque in generated in the main well 709, the steerable device 701 may have a length that is shorter than in prior art, and may hence allow to drill a curved hole 710 within a formation 713, the curved hole 710 having a shorter radius.

The rotating torque may be transmitted to the drill bit 707 by a drive shaft 703 that passes through the drill pipe 705. The drill pipe 705 may be used to transmit axial forces generated at an axial thruster 714. The axial forces may be transmitted either directly to the drill bit, or, as represented on FIG. 7, transmitted to the drive shaft 703 via an axial bearing system 708, e.g. a thrust bearing system.

The drive shaft 703 has to support a fast rotation while being bent. The drive shaft 703 is hence flexible in bending but allows to transmit the rotating torque from the motor 704 to the drill bit 707. As the drive shaft 703 is bent inside the drill pipe 705, the drill pipe 705 may comprise low friction guidance systems 711, e.g. plain bearing systems. Typically, the bearings 711 are substantially uniformly spaced along the drill pipe 705. The bearings 711 may include passages (not represented) allowing a drilling fluid to circulate between the drive shaft 703 and the drill pipe 705. The drive shaft 703 may be made of titanium and the guidance system 711 in bronze.

The drill pipe 705 transmits the axial forces while bent. The drill pipe 705 has a shape corresponding to a hole curvature and is tangent to the drilled hole: a deformation may be achieved in a plastic domain.

Since the motor 704 is located within the main well, the motor 704 may be connected with electrical wires: the motor 704 may be electrical.

The steerable motor may preferably comprise a motor drive shaft (not represented) to transmit the rotating torque from the motor to the drive shaft via a first connector (not represented). In this case, the drive shaft is a further drive shaft. The first connector may provide a fluid communication channel between a motor assembly to the inside of the drill pipe, the motor assembly comprising the motor, the axial thruster, the blocking system and the motor drive shaft. The first connector may be replaced by a second connector (not represented) that also provides a fluid communication channel between a motor assembly to the inside of the drill pipe. The second connector may transmit both the rotating torque and the axial force to the drill pipe.

However, the steerable motor 701 of FIG. 7 comprises a single drive shaft 703 only to transmit the rotating torque from the motor 704 to the drill bit 707, and a single drill pipe 705 to transmit the axial force to the drill bit 707. The steerable motor 701 may not allow to removably connect a first connector or a second connector so as to adapt the transmitting of the rotating torque and the axial force to the drill bit 707 depending on a desired radius of the hole to be drilled.

The steerable device 701 allows to drill a curved hole 710 having a short radius. The drill pipe 705 is bent and three contact points 702 are located on a drill string assembly comprising the drill pipe and the drive shaft. When the curved hole 710 is drilled, the contact points 702 are in contact with a wall of the drilled lateral hole. The three contact points 702 define a drill pipe angle so as to allow to drill the curved hole 710. Positions of the contact points 702 determine a command radius of the curved hole 710.

However, in case of a relatively soft formation, the drill bit may drill the lateral hole overgauge compared with the drill bit. The drilled hole may hence have a relatively large diameter: the wall of the drilled hole may hence be located below an expected wall. As the steerable device 701 relies on the bottom wall of the drilled hole, the drilled curved hole may have an effective radius of curvature that has a greater value than the command radius corresponding to the drill pipe angle.

A control of the effective radius may be performed by combining such an angled mode to a straight mode. During the straight mode, the steerable device 701 itself is oriented by a first angle. The rotating torque generated at the motor 704 and the axial force are transmitted to the drill bit 707 according to a dual transmission configuration for a first determined duration, which allows a drilling of a first hole over a first portion having a first direction. The steerable device 701 is pulled back over a determined distance, e.g. over the first portion. The determined distance may also be greater or smaller than the length of the first portion. The steerable device 701 then is oriented by a second angle. The rotating torque and the axial force are transmitted to the drill bit for a second determined duration, which allows to ream the first hole.

Such steps may be performed in any order, e.g. the rotating of the second angle may be performed before the pulling back. The rotating of the steerable device by a first angle may be performed with a first angle having a null value, i.e. the steerable device may be rotated a single time by a second angle during the performing of the steps.

Figure 8A:
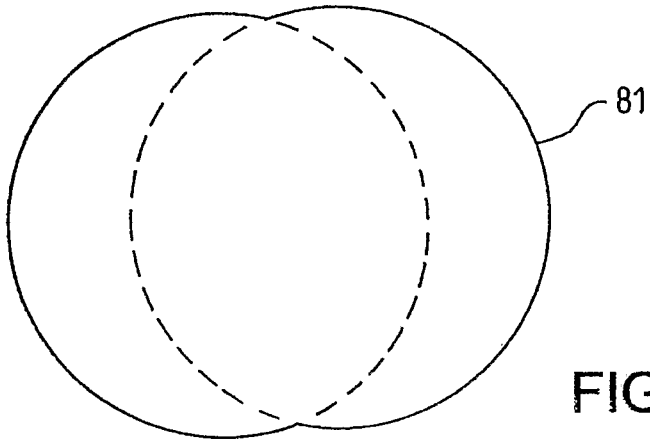
FIG. 8A and FIG. 8B show examples of a section of a drilled hole during a straight mode by a steerable device according to the present invention.
Figure 8B:
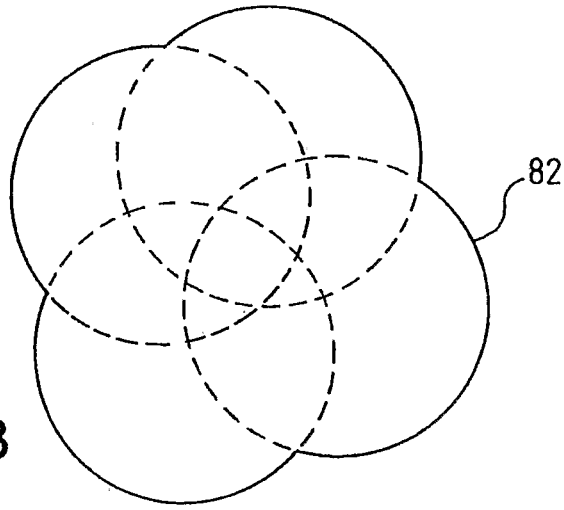

FIG. 8A and FIG. 8B illustrate examples of a section of a drilled hole during the straight mode. The section of FIG. 8A may have been drilled performing the steps described above. Typically, the second angle is substantially equal to 180° and the second determined duration is substantially equal to the first determined duration, which produces an oval hole 81. If the steps are repeated, the steerable device drills the oval hole 81 over a determined length. The oval hole has a larger section than a diameter of the drill bit and has a relatively constant direction.

FIG. 8B illustrates a second example of a section of a drilled hole during the straight mode. In this example, the transmission of the rotating torque and of the axial force to the drill bit is performed four times. For example, the second angle may be substantially equal to 1800 and the second determined duration may be substantially equal to the first determined duration, which produces an oval hole. Then, the steerable device is pulled back and rotated of a third angle, the third angle being substantially equal to 90°. After a third drilling, the steerable device is pulled back and rotated by a fourth angle. The fourth angle is substantially equal to 180°. The rotating torque and the axial force may be transmitted to the drill bit and a fourth drilling is performed. Such operations may be repeated. A resulting section 82 is larger than a diameter of the drill bit.

The straight mode allows to drill following a relatively constant direction, which produces a drilled hole that is relatively straight over the determined distance. When combined to the angled mode, in case of a command radius smaller than a desired radius, the straight mode allows to control an effective radius of the curved hole.

Alternatively, the drill pipe may continuously oscillate from a direction to an opposite direction. The oscillations cause the drill pipe to be rotated over full turns, thus allowing to drill a cylindrical hole having a larger diameter than a section of a drill bit.

If the formation is soft, a jetting mode may be combined to the angled mode, or to the angled mode already in combination with the straight mode. FIG. 7 illustrates an example of such a jetting operation. A jet 712 of fluid is provided so as to erode the formation 713 in a determined direction. In the example of FIG. 7, the drill bit is equipped with a non-symmetrical jet configuration. The drill bit is not rotated, but the motor 704 may orientate the drive shaft 703 so as to orient the jet 712 of fluid in a preferred direction. An offset angle between an azitmuthal direction of the jet 712 of fluid and a reference direction of the motor 704 may be measured. The jetting allows to drill a curved hole following a pre-defined trajectory even in the soft formations, in a more accurate direction than the drilling using a rotation of the drill bit 707.

Control of the Direction of Drilling

In order to control an effective direction of drilling, stabilizers may be set to position a drill bit within a section of a lateral hole. In particular, a variable diameter stabilizer at a bottom hole assembly of a drilling system allows to decide from a remote location if the drilling is to follow a straight direction or change of direction. The changing of direction may allow to drill in an upward direction or a downward direction depending on a configuration of the variable diameter stabilizer among the stabilizers of the bottom hole assembly.

When an operator decides to change the direction of drilling, a mechanical process allows to transmit and set the decision to the variable diameter stabilizer, thus allowing to choose one of the two possible directions. However, if a change of direction for a third distinct direction, e.g. an upward direction if the vertical direction is a downward direction, is required, the bottom hole assembly needs to be removed out of the well. There is thus a need for a more flexible direction controlling system.

Figure 9:
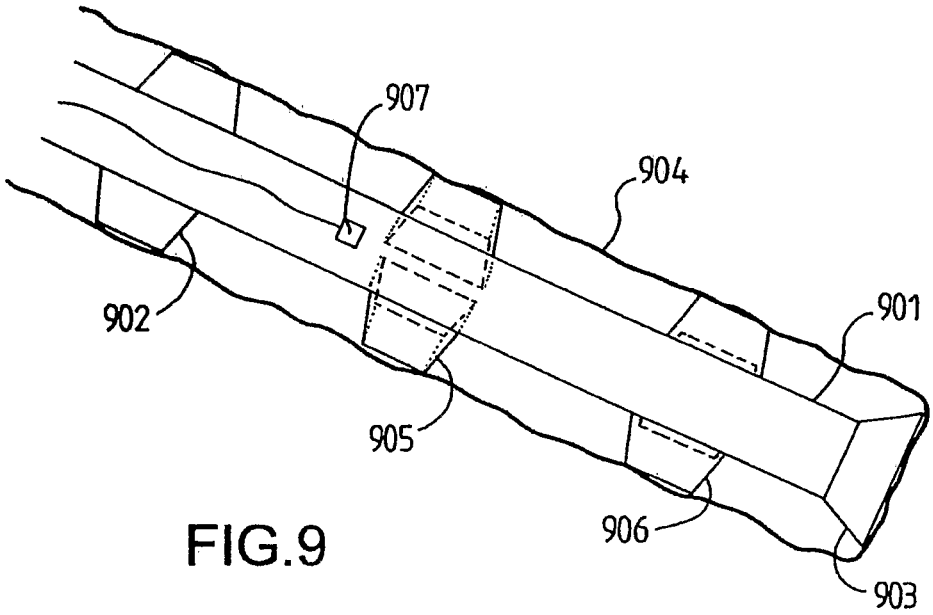
FIG. 9 illustrates an example of a first possible system according to a third embodiment of the present invention.

FIG. 9 illustrates an example of a first possible system according to a third embodiment of the present invention.

A drill bit 903 at an end of a drill string 901 of a bottom hole assembly allows to drill a lateral hole 904. The drill string 901 is surrounded by a plurality of stabilizers (902, 905, 906), wherein at least one stabilizer is a variable diameter stabilizer (905, 906). The at least one variable diameter stabilizer (905, 906) allows to position the drill bit 903 within a section of the lateral hole 904. The system according to the third embodiment of the present invention further comprises controlling means to mechanically control from a remote location at least one stabilizer parameter among a set of stabilizer parameters. The set of stabilizer parameters comprises a diameter size of a determined variable diameter stabilizer (not represented on FIG. 9), a distance between a first stabilizer (not represented on FIG. 9) and a mark device (not represented on FIG. 9). The mark device may be a distinct stabilizer or a drilling bit. The set of stabilizer parameters further comprises a retracting of at least two variable diameter stabilizers (905, 906), and an azimuthal radius of the determined variable diameter stabilizer (not represented on FIG. 9).

The first possible system illustrated in FIG. 9 allows to control from the remote location, e.g. from surface, a retracting of two variable diameter stabilizers (905, 906).

The two variable diameter stabilizers (905, 906) may be set in a coordinated fashion. The first possible system illustrated in FIG. 9 may allow to drill following more than two directions.

The first possible system may comprise only two stabilizers having a variable diameter. Alternatively, as represented in FIG. 9, the first possible system may comprise three stabilizers, with two variable diameter stabilizers among them. Typically, a first variable diameter stabilizer 906 is located close to the drill bit 903, and a second variable diameter stabilizer 905 is located between the two other stabilizers (902, 906).

The first possible system comprises controlling means (not represented on FIG. 9) that comprise more than two setting positions. Each setting position corresponds to an associated value of the stabilizer parameter. In a configuration wherein three stabilizers (902, 905, 906) are involved, as represented in FIG. 9, the stabilizer parameter may describe a retracting or an expanding of the at least two variable diameter stabilizers (905, 906). The corresponding controlling means hence comprises at least three setting positions

- a first setting position associated to a full-gauge position of the first variable diameter stabilizer 906 and of the second variable diameter stabilizer 905;
- a second setting position associated to an under-gauge position of the first variable diameter stabilizer 906 and to a full-gauge position of the second variable diameter stabilizer 905;

a third setting position associated to a full-gauge position of the first variable diameter stabilizer 906 and to an under-gauge position of the second variable diameter stabilizer 905.

A fourth setting position associated to a retracting of both the first variable diameter stabilizer 906 and of the second variable diameter stabilizer 905 may also be comprised within the controlling means.

If the first setting position is selected, the first variable diameter stabilizer 906 and the second variable diameter stabilizer 905 are in a full-gauge position. Consequently the first variable diameter stabilizer 906 and the second variable diameter stabilizer 905 apply contact stresses onto a wall of the lateral hole 904, and the drilling is performed in a relatively straight direction.

Figure 3A:
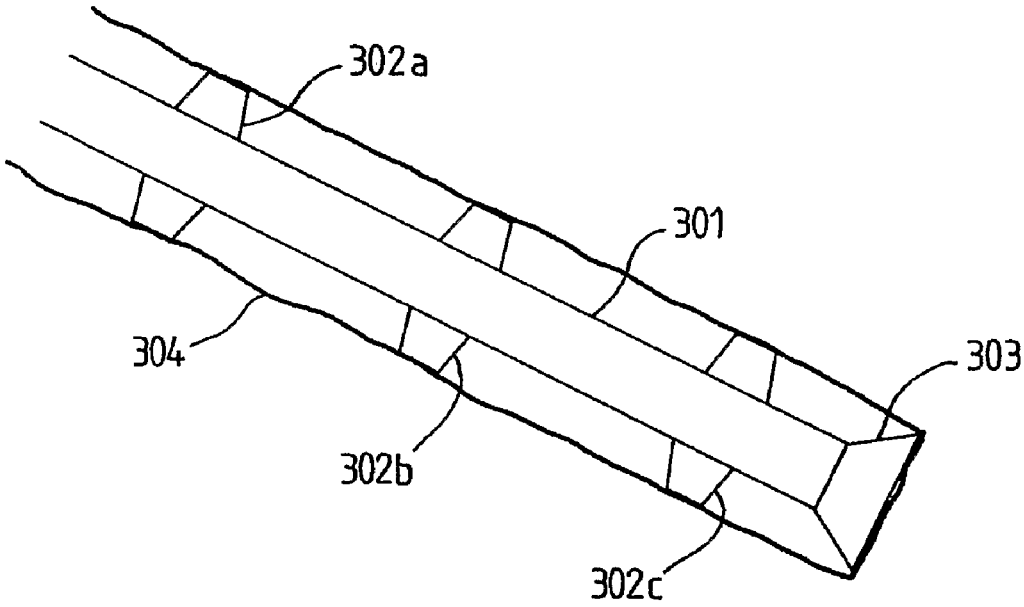
FIG.3A PRIOR ART
FIG. 3A shows an illustration of a straight configuration of a bottom hole assembly according to prior art.
Figure 3B:
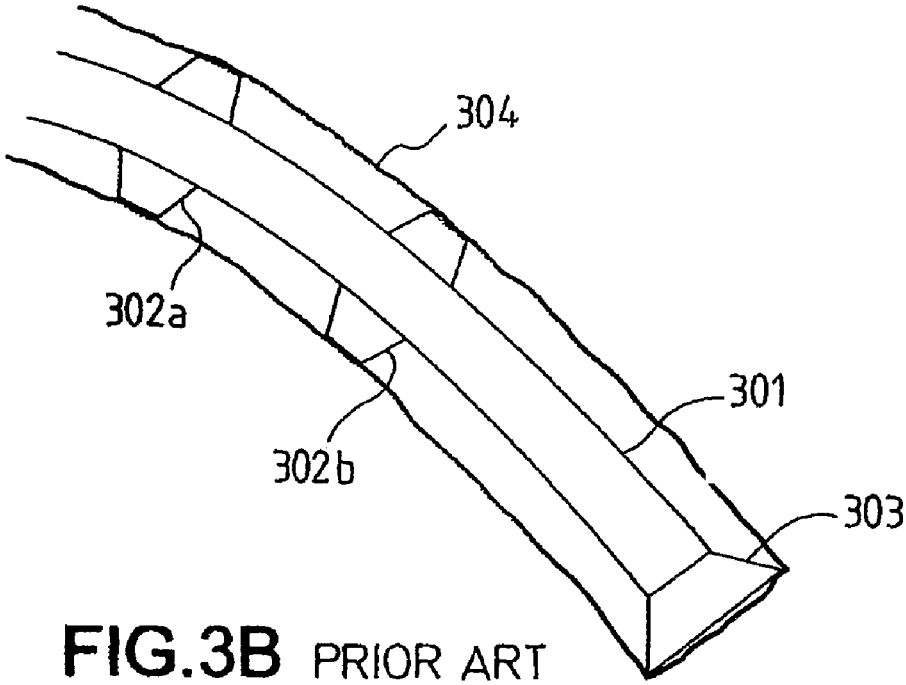
FIG.3B PRIOR ART
FIG. 3B shows an illustration of a drop configuration of a bottom hole assembly according to prior art.

If the second setting position is selected, only the first variable diameter stabilizer 906 is retracted, which provides a configuration that is similar to the one represented on FIG. 3B. A center of the drill bit 903 aims at a downward direction due to a weight of the drill string 901. The drilling is performed in the downward direction.

Figure 3C:
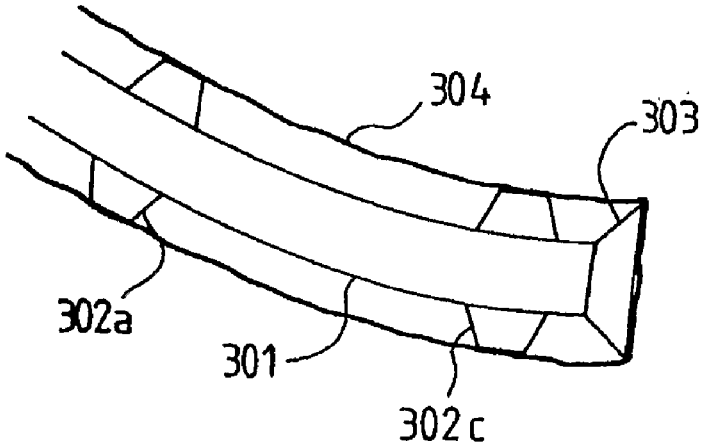
FIG.3C PRIOR ART
FIG. 3C shows an illustration of a build configuration of a bottom hole assembly according to prior art.

A setting to an under-gauge position of the second variable diameter stabilizer 905 only, i.e. only the second variable diameter stabilizer 905 is retracted, provides a configuration that is similar to the one represented on FIG. 3C. A center of the drill bit 903 aims at an upward direction due to a weight of the drill string 901. The drilling is performed in the upward direction.

A Hall Effect sensor 907 may be provided so as measure a diameter of one of the two variable diameter stabilizer. The Hall Effect sensor 907 may detect a retracting of a piston of the variable diameter stabilizer. Alternatively, diameters of the two variable diameter stabilizers may be measured.

The setting of both variable diameter stabilizers (905, 906) is coordinated so as to achieve a desired configuration. If the hole to be drilled is relatively small, the two variable diameter stabilizers (905, 906) may be included in a single drill-collar section (not represented on FIG. 9), which allows to provide a single control unit to control at least one stabilizer parameter among the set of stabilizers parameters.

A second possible system (not represented) according to the third embodiment of the present invention allows to adjust a size of a diameter of at least one determined variable diameter stabilizer. The determined variable diameter stabilizer hence may have more than two positions. For example, the determined variable diameter stabilizer may be extended, retracted or in a middle position.

The second possible system comprises controlling means with at least three setting positions. Each setting position may be selected for example via a configuration plot, e.g. a key, positioned within a configuration slot, e.g. a J-slot. Each setting position corresponds to a position of the determined variable diameter stabilizer.

The second possible system allows to adjust a direction of drilling with a better accuracy than the systems from prior art.

FIG. 10A illustrates a cross section of a third possible system according to a third embodiment of the present invention. Only one half of the third possible system is represented. The third possible system allows to set in a coordinated fashion two variable diameter stabilizers (1001; 1002). Each variable diameter stabilizers (1001; 1002) may be either in a retracted position, a middle position or an extended position. The third possible system hence allows to drill following an upper direction or a lower direction, wherein a direction of drilling may be adjusted with a relatively high accuracy.

The third possible system comprises controlling means with six setting positions (i, j, k, l, m, n). Each setting position corresponds to an associated value of a stabilizer parameter, e.g. an upper variable diameter stabilizer 1001 is extended and a lower variable diameter stabilizer 1002 is retracted, as represented on FIG. 10A. The controlling means allow to shift from a setting position to another upon a relative chronological order of a plurality of events, e.g. a flow is applied before an axial force.

The extending or the retracting of each variable diameter stabilizer (1001; 1002) depends on an extending or a retracting of associated pistons (1003; 1004). The controlling means allow to push an upper piston 1003 and a lower piston 1004 toward an outside of a collar 1000, with respectively an upper controlling sleeve 1010 and a lower controlling sleeve 1007. When no pushing is applied onto a determined piston, the determined piston is retracted.

A ring 1005 mounted on each piston (1003; 1004) allows to prevent the piston (1003; 1004) from being lost in a wellbore.

The lower piston 1004 may be pushed toward an outside of the collar 1000 by sliding on a slope of the lower controlling sleeve 1007. The lower controlling sleeve may slide axially within the collar 1000. A pin 1008 prevents the lower controlling sleeve 1007 from rotating. A lower spring 1040 pushes the lower controlling sleeve 1007 upward. The lower controlling sleeve 1007 extends upwards to a neighbourhood of the upper variable diameter stabilizer 1001. The lower controlling sleeve 1007 may hence have a relatively high length, e.g. several meters.

The sliding of the lower controlling sleeve 1007 is controlled by a finger 1009 of the upper controlling sleeve 1010. The upper controlling sleeve 1010 may slide axially within the collar 1000 and may be rotated in a single direction: a ratchet system 1011 prohibits a backward rotation of the upper controlling sleeve 1010.

FIG. 10B illustrates an example of a ratchet system 1011 of a third possible system according to the third embodiment of the present invention. The ratchet system 1011 comprises inclined teethes 1042 into which a pawl 1041 drops to allow effective motion in a single direction only.

Referring back to FIG. 10A, the ratchet system 1011 allows a sliding of the upper controlling sleeve 1010 within the collar 1000.

The finger 1009 pushes the lower controlling sleeve 1007 by different contact areas (1012, 1013, 1014, 1043, 1044, 1045) depending on an azimuthal position of the upper controlling sleeve 1010.

FIG. 10C illustrates an example of a lower controlling sleeve 1010 of a third possible system according to the third embodiment of the present invention. The lower controlling sleeve comprises a plurality of contact areas (1012, 1013, 1014, 1043, 1044, 1045).

If the finger 1009 is aligned with full-gauge contact areas (1012; 1044; 1045), the upper controlling sleeve 1007 is pushed inside the collar 1000. As a result, the lower piston 1004 is in the extended position.

If the finger 1009 is aligned with middle-gauge contact areas (1013; 1043), the lower piston 1004 is in the middle position.

If the finger 1009 is aligned with an under-gauge contact area 1014, the lower piston 1004 is in the retracted position.

The diameter of the lower stabilizer 1002 hence depends on the contact area with which the finger 1009 is aligned.

Referring now to FIG. 10A, the upper controlling sleeve 1010 comprises three slopes (1015, 1016, 1017) on which the lower piston 1003 may rely. The slopes have distinct azimuthal positions.

FIG. 10D illustrates an example of an upper controlling sleeve 1010 of a third possible system according to the third embodiment of the present invention. The upper controlling sleeve 1010 comprises three slopes (1015, 1016, 1017) having a same slope angle. The slopes (1015, 1016, 1017) start at distinct axial positions on the upper controlling sleeve 1010.

Referring back to FIG. 10A, if the upper controlling sleeve 1010 has an axial position such that the upper piston 1003 relies on a first slope 1017, the upper piston may be pushed outside to the extended position. A second slope 1016 allows to position the upper piston 1003 to the middle position, and the third slope 1015 allows to let the upper piston 1003 retracted.

The upper controlling sleeve 1010 comprises a finger 1009 that controls a size of the lower piston 1004. Each contact area is combined with a given height of the upper controlling sleeve 1010. Each setting position (i, j, k, l, m, n) is associated to a combination of a determined contact area (1012, 1013, 1014, 1043, 1044, 1045) and of a determined slope (1015; 1016; 1017).

FIG. 10E illustrates a setting table of a third possible system illustrated in FIG. 10A. For example, the full-gauge contact area 1012 is combined with the first slope 1017. The combination is associated to a first setting position i that corresponds to an extending of both pistons (1003; 1004), which allows to drill following a straight direction.

A third setting position k is associated to a combining of the under-gauge contact area 1014, i.e. the lower piston 1004 is retracted, to the first slope 1017, i.e. the upper piston 1003 is extended. The third setting position k allows to drill following a downward direction.

A second setting position j is associated to a combining of the middle-gauge contact area 1013, i.e. the lower piston 1004 is retracted, to the first slope 1017, i.e. the upper piston 1003 is extended. The second setting position j allows to drill following an intermediate downward direction.

Three other setting positions (l, m, n) are illustrated in the setting table of FIG. 10E.

Referring back to FIG. 10A, the azimuthal position of the upper controlling sleeve 1010 is controlled by a position of a configuration plot, e.g. a key 1021 within a configuration slot, e.g. a J-slot 1025. The J-slot 1025 is located on a J-slot sleeve 1018. The key 1021 is mounted on an upper mandrel extension 1022.

FIG. 10F illustrates an example of a J-slot of a third possible system illustrated in FIG. 10A. The J-slot 1025 allows to shift from one setting positions (i, j, k, l, m, n) to an other.

If the flow from a remote pump (not represented) occurs before an applying of the axial force, the J-slot sleeve 1018 is forced downward by a pressure drop generated by the flow. During a downward stroke, the key 1021 is moved within the J-slot 1025, thus inducing a rotation of the J-slot sleeve 1018.

Referring now to FIG. 10A, a teeth 1019 allows to rotate the upper controlling sleeve 1010 upon the rotation of the J-slot sleeve 1018. However, a free rotation of the J-slot sleeve 1018 relative to the upper controlling sleeve 1010 may also be allowed depending on an engagement of the teeth 1019.

If the upper controlling sleeve 1010 is moved downward, the upper piston 1003 may be pushed depending on the slope (1015, 1016, 1017) on which the upper piston 1003 rely.

The rotation of the upper controlling sleeve 1010 allows to align the finger 1009 with a determined contact area (1012, 1013, 1014, 1043, 1044, 1045), thus controlling the diameter of the lower variable diameter stabilizer 1002.

If the axial force is applied before the flow, the upper mandrel 1023 is moved downward until an end 1046 of the upper mandrel 1023 contacts an extremity 1047 of a lower mandrel 1026. The upper mandrel extension 1022 pushes the J-slot sleeve 1018, so that no relative movement between the J-slot sleeve 1018 and the upper mandrel extension 1023 occurs. The J-slot sleeve 1018 is hence not rotated.

When the teeth 1019 is engaged such that the upper controlling sleeve 1010 is rotated upon the rotation of the J-slot sleeve 1018, the shifting from one setting position (i, j, k, l, m, n) to an other is provided by applying the flow before the axial force. If no shift is desired, the axial force is applied before the flow. Under proper conditions, a displacing of the key 1021 allows to select a desired setting position among a set of setting positions (i, j, k, l, m, n).

The third possible system according to a third embodiment of the present invention may further comprise a position indicator 1028. When the upper mandrel 1023 is pushed downwards into the lower mandrel 1026, the position indicator 1028 moves downwards. A spring 1030 allows to insure that the displacement of the position indicator 1028 is limited by a mechanical stop 1029 of the J-slot sleeve 1018. The mechanical stop 1029 has a length that depends on the azimuthal position of the J-slot sleeve 1018. As a consequence, the displacement of the position indicator 1028 depends on the azimuthal position of the J-slot sleeve 1018. As a pressure drop at a nozzle of the position indicator 1028 depends on the displacement of the position indicator, it is possible, by monitoring the pressure drop, to detect the azimuthal position of the J-slot sleeve 1018.

The possible free rotation of the J-slot sleeve 1018 relative to the upper controlling sleeve 1010 may also be taken into consideration. Consequently, the diameters of the variable diameter stabilizers (1001, 1002) may be evaluated. Splines and grooves (not represented on FIG. 10A) allow to prevent the upper mandrel 1023 to rotate relative to the lower mandrel 1026. The axial force is on the contrary transmitted from the upper mandrel 1023 to the lower mandrel 1026 by contacting the end 1046 of the upper mandrel 1023 and the extremity 1047 of the lower mandrel 1026. A back contact 1033 allows to transmit an extension force from the upper mandrel 1023 to the lower mandrel 1026 when the system is hoisted out of the drilled hole.

Figure 2:
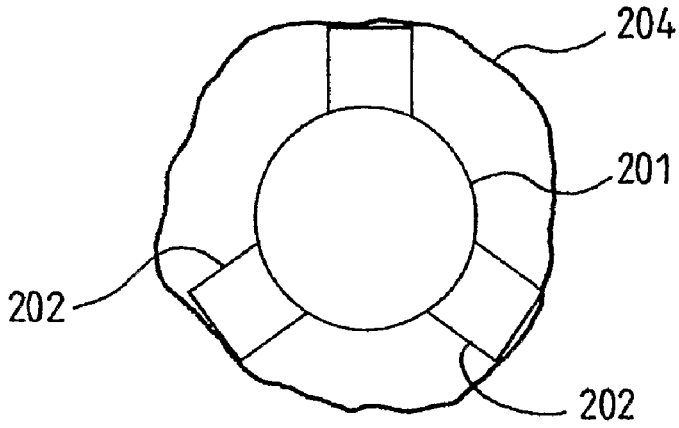
FIG.2 PRIOR ART
FIG. 2 shows an illustration of a stabilizer according to prior art.

A fourth possible system (not represented) according to the third embodiment of the present invention allows to control from a remote location an azimuthal radius of a determined variable diameter stabilizer. The determined variable diameter stabilizer may indeed be an azimuthally adjustable stabilizer comprising a plurality of pistons, e.g. three pistons, as represented in FIG. 2. Each piston has a determined azimuthal direction.

In the fourth possible system, each piston may be set independently of the others. The fourth possible system comprises controlling means with at least three setting positions, each setting position corresponding to a determined value of a stabilizer parameter, e.g. only a first piston is extended.

When a determined piston of the azimuthally adjustable stabilizer close to a drill bit is pushed onto a wall of a drilled hole, the drill bit drills in a direction that is opposite to a determined azimuthal direction of the determined piston. Particular care may be taken to synchronize the pushing of the determined piston with a possible rotation of a drill string of a bottom hole assembly.

As each piston of the azimuthally adjustable stabilizer may be set independently, it is possible to order a drilling following any direction, e.g. an horizontal direction.

A fifth possible system according to the third embodiment of the present invention allows to control from a remote location, e.g. from surface, a longitudinal position of a first stabilizer relative to a mark device. The mark device may be mounted on a bottom hole assembly: for example, the mark device may be a distinct stabilizer or a drill bit. The first stabilizer may be a variable diameter stabilizer or any other device allowing to position a center of a drill string in a center of a section of a drilled hole, e.g. a stabilizer.

An adjusting of the longitudinal position of the stabilizer relative to the drill bit may be performed by adjusting a size of a sliding section, or by displacing the stabilizer along a drill string. The adjusting of the distance between two stabilizers allows to adjust a deformation of the drill string between the two stabilizers, and hence to adjust a direction of drilling.

Figure 11:
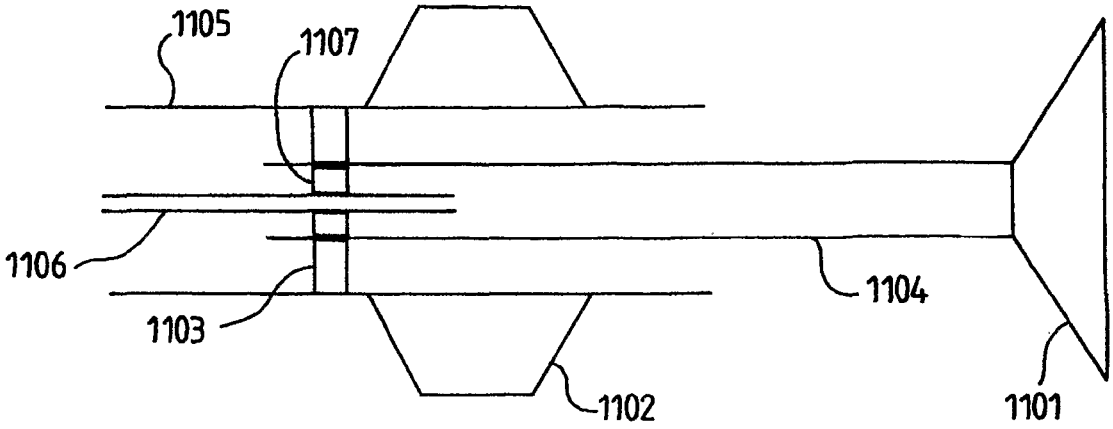
FIG. 11 shows an illustration of a fifth possible system according to the third embodiment of the present invention.

FIG. 11 illustrates a fifth possible system according to the third embodiment of the present invention. The fifth possible system allows an adjustment of a distance between a stabilizer 1102 and a drill bit 1101, and hence an adjustment of a direction of drilling. The system comprises a drill string 1105 inside of which is located a sliding mandrel 1104. The drill bit 1101 is located at an end of the sliding mandrel 1104.

The direction of drilling depends on an elastic deformation of the sliding mandrel 1104 over a distance between the stabilizer 1102 and the drill bit 1101.

A sealing-blocking system 1103 comprises locking means, e.g. internal slips, so as to maintain the sliding mandrel 1104 at a determined position. The sealing-locking system 1103 may also comprise a seal, e.g. a rubber element, to insure a sealing so that a circulation of a drilling fluid reaches the drilling bit 1101 via an inside of the sliding mandrel 1104.

The internal slips may be controlled by a physical parameter, e.g. pressure, of a control shaft 1106. A transmitting system 1107 allows the control shaft 1106 to communicate with the sliding mandrel 1104 and the sealing blocking system 1103. The transmitting system 1107 typically allows to set the internal slips and to transmit a displacement of the control shaft 1106. The transmitting system 1107 comprises at least one hole so as to allow the circulation of the drilling fluid through the sliding mandrel 1104.

When the internal slips are unset, the sliding mandrel may be moved. A pulling onto the control shaft 1106 allows to reduce the distance between the stabilizer 1102 and the drill bit 1101. The distance between the stabilizer 1102 and the drill bit 1101 may also be increased, e.g. by pushing onto the control shaft 1106.

The sealing-blocking system 1103 may also transmit a rotating torque and an axial force from the drill string 105 to the sliding mandrel 1104. Alternatively, the rotating torque is transmitted from an alternative shaft (not represented) to the drill bit 1101.

The direction controlling system according to the third embodiment of the present invention is embedded into a drill string assembly of a drilling system. Preferably, the drill string assembly is removably connected to a motor assembly with a connector. The motor assembly may comprise a motor to generate a rotating torque, an axial thruster to generate an axial force, a blocking system to fix the motor and the axial thruster downhole, and a drive shaft to transmit the rotating torque to the drill string assembly.

The connector allows to transmit the rotating torque and the axial force from the motor assembly to the drill string assembly. The drill string assembly comprises a drill bit and a drill pipe. The connector provides a fluid communication channel between the motor assembly and the inside of the drill pipe.

The connector comprises either a first connector or a second connector. The first connector may be connected to the drill string assembly so as to transmit the axial force only to the drill pipe and to transmit the rotating torque to a further drive shaft positioned within the drill pipe. The drill bit is located at an end of the rotating further drive shaft located inside the drill pipe, the drill pipe transmitting the axial force. A plurality of stabilizers surrounds the drive shaft. In particular, the fourth possible system of the third embodiment of the present invention may be employed with a non-rotating drill pipe.

Such a dual transmission configuration is particularly adapted for drilling following a curve.

The second connector may also be connected to the drill string assembly. The second connector allows to transmit both the axial force and the rotating torque to the drill pipe. The drill pipe transmits both the rotating torque and the axial force to the drill bit. Such a rotary transmission configuration is particularly adapted for drilling substantially following a straight direction. A plurality of stabilizers surrounds the drill pipe to insure an adequate guidance of the drill string.

Alternatively, the drilling system may also comprise a single drive shaft to transmit the rotating torque from a motor to a drill bit, and a single drill pipe to transmit an axial force to the drill bit. The single drill pipe may not be distinct from the single drive shaft. The drilling system may fail to allow to removably connect a first connector or a second connector so as to adapt the transmitting of the rotating torque and the axial force to the drill bit depending on a desired radius of the hole to be drilled.

Monitoring the Direction of Drilling

Controlling a trajectory of drilling requires monitoring an orientation of a drill bit. The monitoring is usually performed with an accelerometer system comprising at least one accelerometer that provides a measurement of an inclination of a drill string relative to the Earth gravity vector. A magnetometer system comprising at least one magnetometer allows to measure an azimuth of the drill string versus the Earth magnetic field. The accelerometer system may be associated with the magnetometer system. However, in the systems from prior art, the magnetometer system and the accelerometer system are located at a relatively long distance from the drill bit, e.g. 25 meters. There is a need for a system in which a more accurate measurement of the orientation of the drill bit may be provided.

Figure 12:
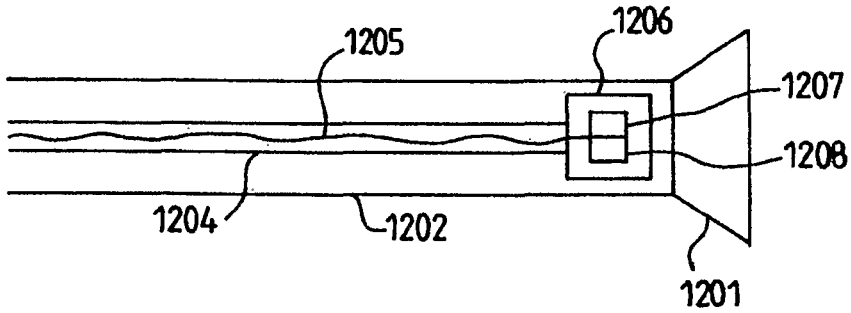
FIG. 12 shows an illustration of a bottom hole assembly according to a fourth embodiment of the present invention.

FIG. 12 illustrates a bottom hole assembly according to a fifth embodiment of the present invention. The bottom hole assembly comprises a drill bit 1201 to drill a hole. The bottom hole assembly further comprises at least one micro-sensor (1207, 1208) in a close neighborhood of the drill bit 1201. The at least one micro-sensor (1207, 1208) allows a measurement of an orientation of the drill bit 1201 relative to a reference direction.

The at least one micro-sensor may be a micro-magnetometer 1207 that allows a measurement of an orientation of the drill bit 1201 relative to the Earth magnetic field. Such micro-magnetometer may belong to a Micro Opto-Electro-Mechanical Systems (MOEMS) family.

Preferably three micro-magnetometers are provided at the close neighborhood of the drill bit so as to measure three orientations of the drill bit relative to the Earth magnetic field. A three dimensions measurement of the orientation of the drill bit is hence provided.

The micro-magnetometer 1207 may also be a micro-accelerometer 1207. The micro-accelerometer 1207 allows a measurement of an orientation of the drill bit 1201 relative to the Earth gravity vector. The micro-accelerometer may belong to a Micro Electro Mechanical Systems (MEMS) family.

Preferably three micro-accelerometers are provided at the close neighborhood of the drill bit so as to measure three orientations of the drill bit relative to the Earth gravity vector. A three dimensions measurement of the orientation of the drill bit is hence provided.

The system may also comprise both the three micro-accelerometers and the three micro-magnetometers.

The micro-accelerometers and the micro-magnetometers themselves may respectively provide less accurate measurements than conventional accelerometers and conventional magnetometers. However, the system, thanks to the locating of the micro-sensors in the close neighborhood of the drill bit, allows to provide a more accurate measurement of the orientation of the drill bit than the systems from prior art.

The at least one micro-sensor allows to monitor the orientation of the drill bit 1201. The micro-magnetometer 1207 and the micro-accelerometer 1207 may be located within a sub-assembly 1206 close to the drill bit 1201.

An electric motor (not represented) may generate a rotating torque allowing to rotate the drill bit 1201. The electric motor has a length that is relatively smaller than a length of a hydraulic motor.

The bottom hole assembly according to the present invention may comprise a small tube 1204 in a center of a drill string 1202. The small tube 1204 allows a communicating between a main sub (not represented) and the micro-sensors (1207, 1208). The main sub may be located within a main well from which a lateral hole is being drilled using the bottom hole assembly. The main sub may also be a Measurement While Drilling tool located along a longitudinal axis of the bottom hole assembly at a relatively long distance from the drill bit 1201.

The communicating may be performed by means of electrical wires 1205. The communicating may also be performed by means of electrical signals transmitted to the micro-sensors (1207, 1208) through the small tube 1204 and returned from the micro-sensors (1207, 1208) through the drill string 1202. The small tube 1204 needs to be electrically isolated from the drill string 1202.

Preferably, the bottom hole assembly according to the present invention is part of a drilling system according to the first embodiment of the present invention.

Alternatively, the micro-sensors are located in a close neighborhood of a drill-bit of an alternative drilling system, wherein the alternative drilling system fails to allow to removably connect a first connector or a second connector so as to adapt the transmitting of the rotating torque and the axial force to the drill bit depending on a desired radius of the hole to be drilled.

The alternative drilling system may be a steerable motor, a steerable device, a drilling rig system, a coiled tubing system, or any other drilling system.

In a case (not represented) of a steerable device, the micro-sensors may be located within a drive shaft.

In a case of a bottom hole assembly with a direction controlling system (not represented), the micro-sensors may for example be located within a control unit (not represented).

Very Short Radius Drilling

A drilling system for drilling a lateral hole departing from a main well with a very short radius curve may comprise a flexible drill pipe that is bent substantially perpendicularly at an elbow between the main well and a drilled lateral hole. A motor and an axial thruster may be blocked within the main well and the flexible drill pipe transmits a rotating torque and an axial force to a drill bit. The drilling systems from prior art comprise either a whipstock or bushings, so as to allow the transmitting of the rotating torque and the axial force at the elbow.

However, in case of a relatively long lateral hole, the transmitting of the rotating torque and the axial force may be relatively delicate due to an intensity of the axial force along the flexible drill pipe.

The whipstock has to support the axial force from the axial thruster and a compression force from the drill bit. A reaction force acting onto the whipstock may be calculated as a vectorial combination of the axial force and the compression force.

Furthermore, the drill pipe slides over the whipstock during the drilling as the drilled lateral well grows. However, when drilling, a tangential velocity of the drill pipe is higher than a sliding velocity. Typically, a ratio between the tangential velocity and the sliding velocity is within a range of one hundred. A combined velocity resulting from a vectorial sum of the tangential velocity and the sliding velocity is hence substantially equal to the tangential velocity.

The reaction force and the combined velocity may generate significant friction loss and wear. There is a risk that the whipstock, or a rock formation behind the whipstock, explode because of stresses transmitted by the flexible shaft.

There is a need for a system allowing a transmitting of a rotating torque and of a relatively high axial force along a flexible shaft at a bend of the flexible shaft.

Figure 13A:
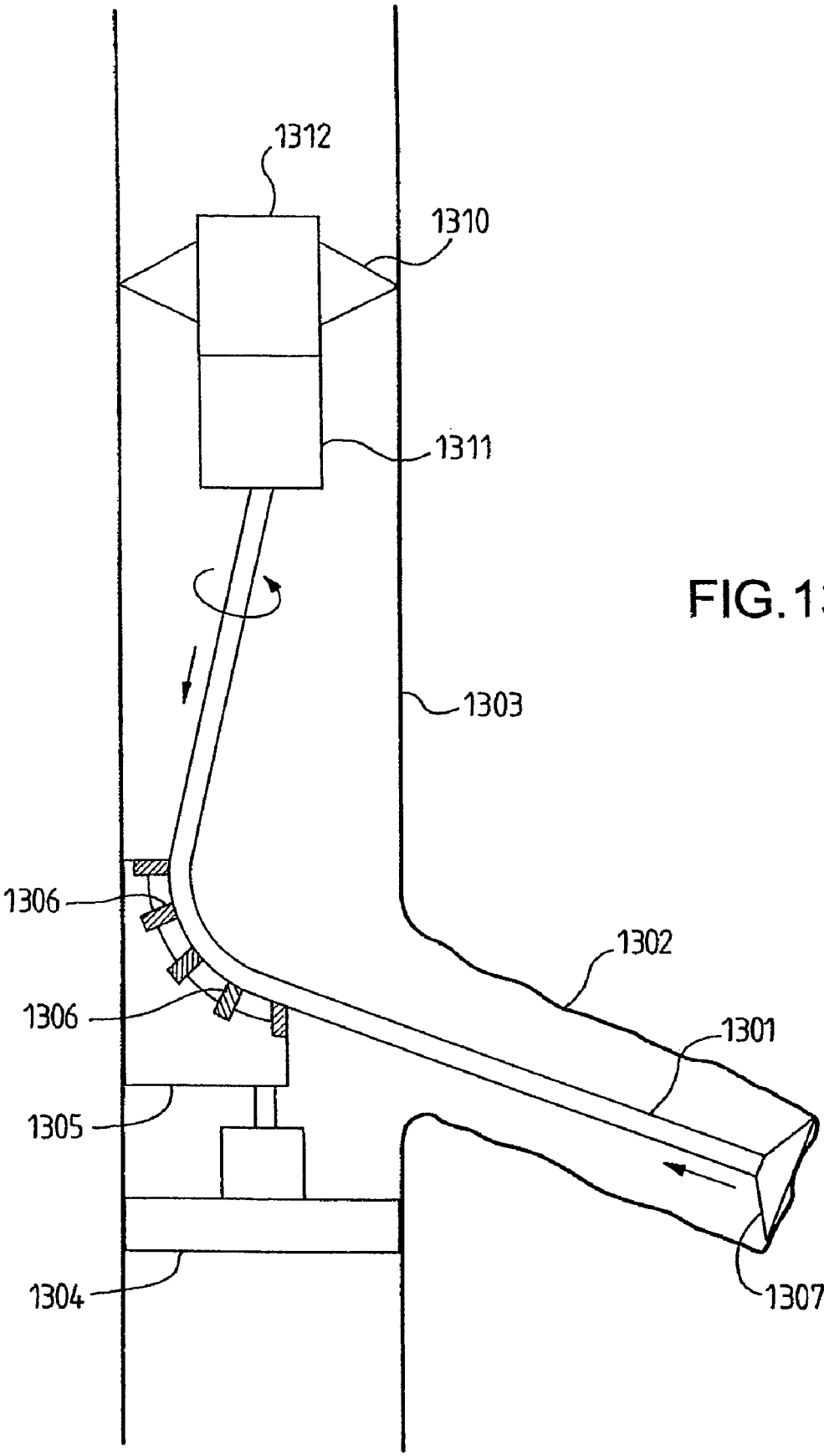
FIG. 13A illustrates an example of a drilling system according to a fifth embodiment of the present invention.

FIG. 13A illustrates an example of a drilling system according to a fifth embodiment of the present invention. A drill bit 1307 at an end of a drill pipe 1301 drills a lateral hole 1302 departing from a main well 1303. The drill pipe 1301 transmits both a rotating torque and an axial force to the drill bit 1307. The drill pipe 1301 is flexible so as to allow a bending while transmitting the rotating torque and the axial force. The drilling system further comprises a bending guide 1305 with rotating supports 1306 to support the drill pipe at the bend. The lateral hole may depart substantially perpendicularly from the main well.

The rotating torque and the axial force may be generated respectively by a motor 1312 and an axial thruster 1311. A blocking system 1310 may block the motor 1312 and the axial thruster 1311 within the main well 1303. The motor 1312 may be electrical.

A guide mandrel 1304 may be provided so as to block the bending guide 1305 within the main well. The guide mandrel may comprise an orientating sub (not represented) that sets and allows to measure an azimuthal direction of the bending guide so as to drill following a proper azimuthal direction. The guide mandrel 1304 may communicate with a control sub (not represented) located close to the motor 1312 using an electrical wiring system (not represented). In this case, particular care may be taken to protect the electrical wiring system from the rotating drill pipe 1301. Alternatively, the guide mandrel 1304 may communicate with the control sub using a wireless communication system (not represented), such as electromagnetic or acoustic telemetry.

A pump (not represented) may insure a circulation of a drilling fluid into the drill string 1301 and in an annulus between the drilled lateral hole and the drill string 1301.

The bending guide 1305 allows to insure the substantially perpendicular bending of the drill pipe 1301 while transmitting the rotating torque and the axial force.

Figure 13B:
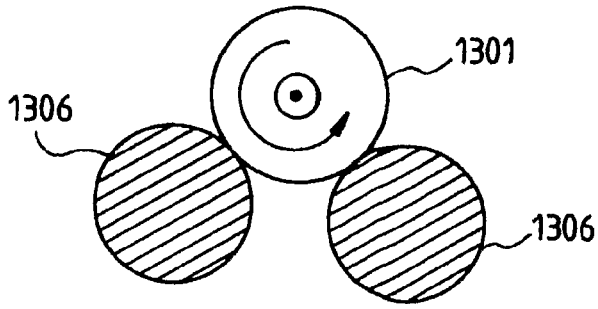
FIG. 13B shows an illustration of a first example of a bending system according to a fifth embodiment of the present invention.

FIG. 13B illustrates a cross section of a first example of a bending system according to the fifth embodiment. A drill pipe 1301 transmits both the rotating torque and the axial force. Rotating supports 1306, e.g. rollers, allow relatively easy rotation of the drill pipe 1301.

However, with the first example of bending system, the drill pipe 1301 is supported by relatively small contact areas of the rollers 1306. In a case of a very high axial force, there is a risk that the drill string be locally deformed.

Figure 14A:
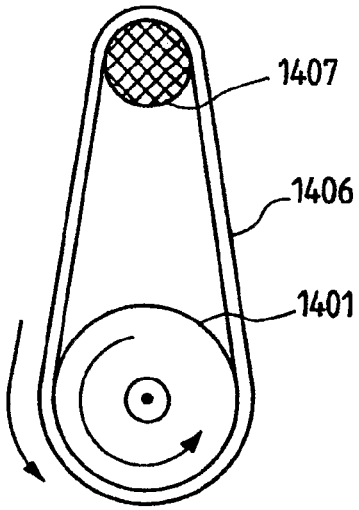
FIG. 14A and FIG. 14B illustrate a second example of a bending system according to the fifth embodiment of the present invention.
Figure 14B:
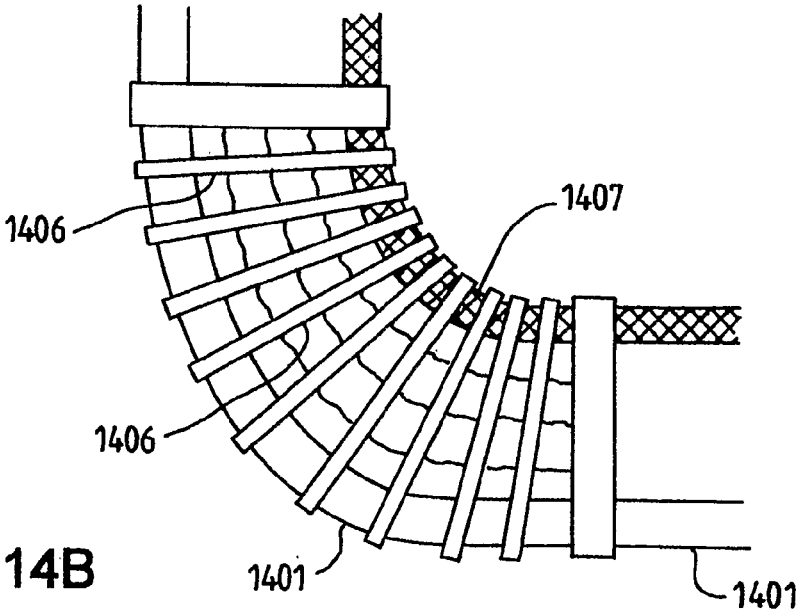

FIG. 14A and FIG. 14B illustrate a second example of a bending system according to the fifth embodiment of the present invention. FIG. 14A shows a cross section of the bending system whereas FIG. 14B shows a side view of the bending system. A drill pipe 1401 is bent between two bending guides (not represented). The drill pipe is in contact with a net of rotating supports, e.g. belts 1406. The belts 1406 pass over the drill pipe 1401 and a flexible support, e.g. a pulley 1407. Such a pulley system allows to insure a proper orientation for each belt 1406. The belts 1406 have a movement that follows a rotation of the drill pipe 1401.

The belts 1406 transmit a reaction force from the drill pipe 1401 to the pulley 1407. Bearings (not represented) may be provided at both ends of the flexible support 1407. The bearings allow the flexible support to be rotated upon rotation of the drill pipe. The bearings may be blocked within the main well so as to resist to the reaction force from the drill pipe 1401.

The belts 1406 need to be relatively flexible. The belts 1406 may be ropes or woven structures attached to the pulley 1407.

The second example of the bending system allows a supporting of the drill pipe 1401 over a relatively large surface area.

Preferably, the drilling system according to the present invention comprises a motor assembly. The motor assembly comprises a motor to generate a rotating torque, an axial thruster to generate an axial force, a blocking system to fix the motor and the axial thruster within the main well and a drive shaft to transmit the rotating torque.

The drilling system may allow to removably connect a first connector or a second connector so as to adapt the transmitting of the rotating torque and the axial force to a drill bit depending on a desired radius of the hole to be drilled. The first connector may provide a transmitting of the axial force only to a drill pipe, the rotating torque being transmitted to a further drive shaft positioned within the drill pipe. On the contrary, the second connector may transmit both the axial force and the rotating torque to the drill pipe.

Both the first connector and the second connector may provide a fluid communication channel for a circulating of a drilling fluid between the motor assembly and the inside of the drill pipe.

The second connector may be located within the main well and the drill pipe may be flexible enough so as to allow a substantially perpendicular bending while transmitting the rotating torque and the axial force. The drilling of the lateral hole may be performed following substantially a straight direction from the main well.

Alternatively, as represented on FIG. 13A, the drilling system according to fifth embodiment of the present invention comprises a single drill pipe 1301 that transmits a rotating torque and an axial force from a motor and an axial thruster to a drill bit. The motor and the axial thruster may be located within a main well, or within a lateral hole. The drilling system may not allow to removably connect a first connector or a second connector so as to adapt the transmitting of the rotating torque and the axial force to the drill bit depending on a desired radius of the lateral hole to be drilled.

Flow and Cuttings Management

Drilling a hole creates cuttings that need to be processed. The systems from prior art involve a pump located at surface that injects a drilling fluid, e.g. a drilling mud, through a drilling tool. The drilling fluid reaches a drill bit of the drilling tool and is evacuated through an annulus between the drilling tool and the drilled hole. The drilling fluid is viscous enough to carry the cuttings that are created at the drill bit up to the surface. A shale shaker located at the surface allows to remove the cuttings from the drilling fluid.

In a wireline system, wherein the pump is located downhole to pump the drilling fluid, the cuttings may not reach the surface. There is a need for processing the flow of drilling fluid and the cuttings in a case of a system with a pump downhole.

Figure 15:
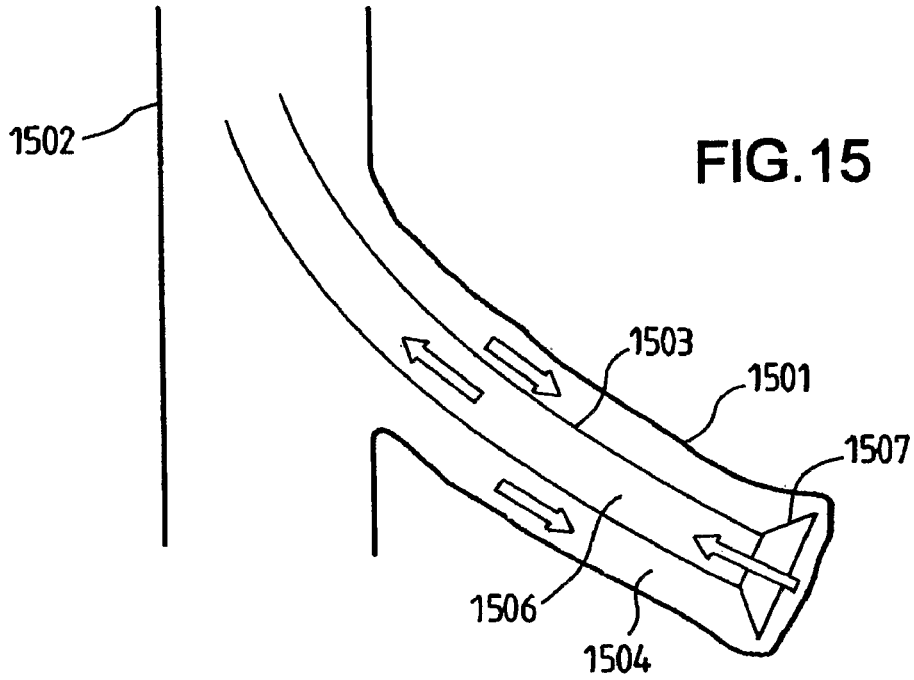
FIG. 15 illustrates an example of a drilling system according to a sixth embodiment of the present invention.

FIG. 15 illustrates an example of a drilling system according to a sixth embodiment of the present invention. A drilling system comprises a drill string assembly 1503. A drill bit 1507 drills a lateral hole 1501 departing from a main well 1502. A drilling fluid circulates to the drill bit 1507 through an annulus 1504 between the drilled lateral hole 1501 and the drill string assembly 1503. The drilling fluid circulates from the drill bit 1507 to the main well through a fluid communication channel 1506, thus carrying cuttings generated at the drill bit 1507.

As the drill string assembly 1503 has a smaller section than a casing (not represented) of the main well 1502, the drilling fluid may circulate relatively rapidly through the fluid communication channel 1506, which allows to avoid a sedimentation of the cuttings due to gravity.

The carrying of the cuttings through the fluid communication channel 1506 requires less pumping power than in a conventional circulation wherein the cutting are carried through the annulus 1504.

Furthermore, the fluid communication channel 1506 allows to properly guide the cutting to a further separating.

The drilling of the lateral hole 1501 generates the cuttings that are carried through the fluid communication channel 1506. It is hence necessary that the drill bit 1507 comprises large holes to allows a passage of the cuttings.

Figure 16:
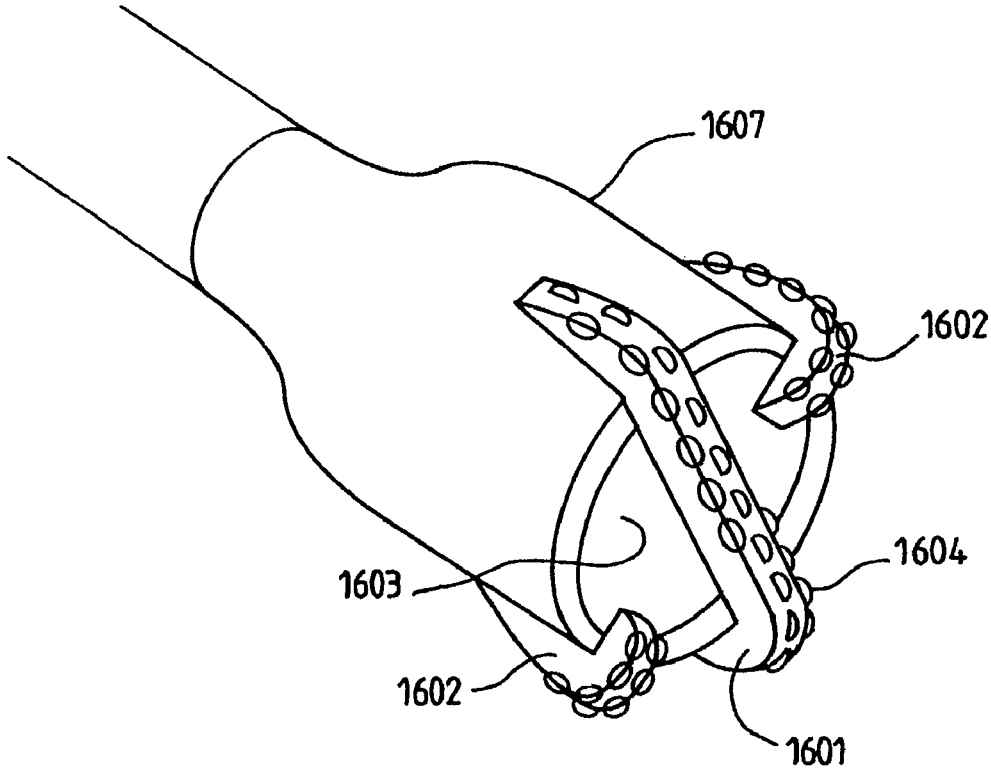
FIG. 16 illustrates an example of a drill bit according to a sixth embodiment of the present invention.

FIG. 16 illustrates an example of a drill bit according to the sixth embodiment of present invention. The drill bit 1607 may be fish-tail shaped. The drill bit 1607 may comprise a main blade 1601 to insure a cutting action. Cuttings generated during a drilling by the drill bit 1607 may be evacuated by a circulation of a drilling fluid through a bit hole 1603. The bit hole 1603 that has a relatively large section to allow the evacuating of the cuttings through the drill bit 1607. The drill bit may further comprise guiding blades 1602 to insure a side guidance in the drilled hole and stabilize a direction of drilling. The main blade 1601 and the guiding blade 1602 may comprise cutters 1604.

The main blade 1601 may be straight following a diameter of the drill bit 1607, as represented in FIG. 16. Alternatively, the main blade has a curved shape passing by a center of a section of the drill bit 1607.

Alternatively, the drill bit may comprise a plurality of blades, wherein at least one blade traverses the section of the drill bit.

The drill may comprise a centering spike (not represented) to stabilize a direction of drilling.

Preferably, the drilling system according to the present invention comprises a motor assembly. The motor assembly comprises a motor to generate a rotating torque, an axial thruster to generate an axial force, a blocking system to fix the motor and the axial thruster within the main well and a drive shaft to transmit the rotating torque.

The drilling system may allow to removably connect a first connector or a second connector so as to adapt the transmitting of the rotating torque and the axial force to a drill bit depending on a desired radius of the hole to be drilled. The first connector may provide a transmitting of the axial force only to a drill pipe, the rotating torque being transmitted to a further drive shaft positioned within the drill pipe. On the contrary, the second connector may transmit both the axial force and the rotating torque to the drill pipe.

Both the first connector and the second connector allow to provide the fluid communication channel between the motor assembly and the inside of the drill pipe.

Figure 17:
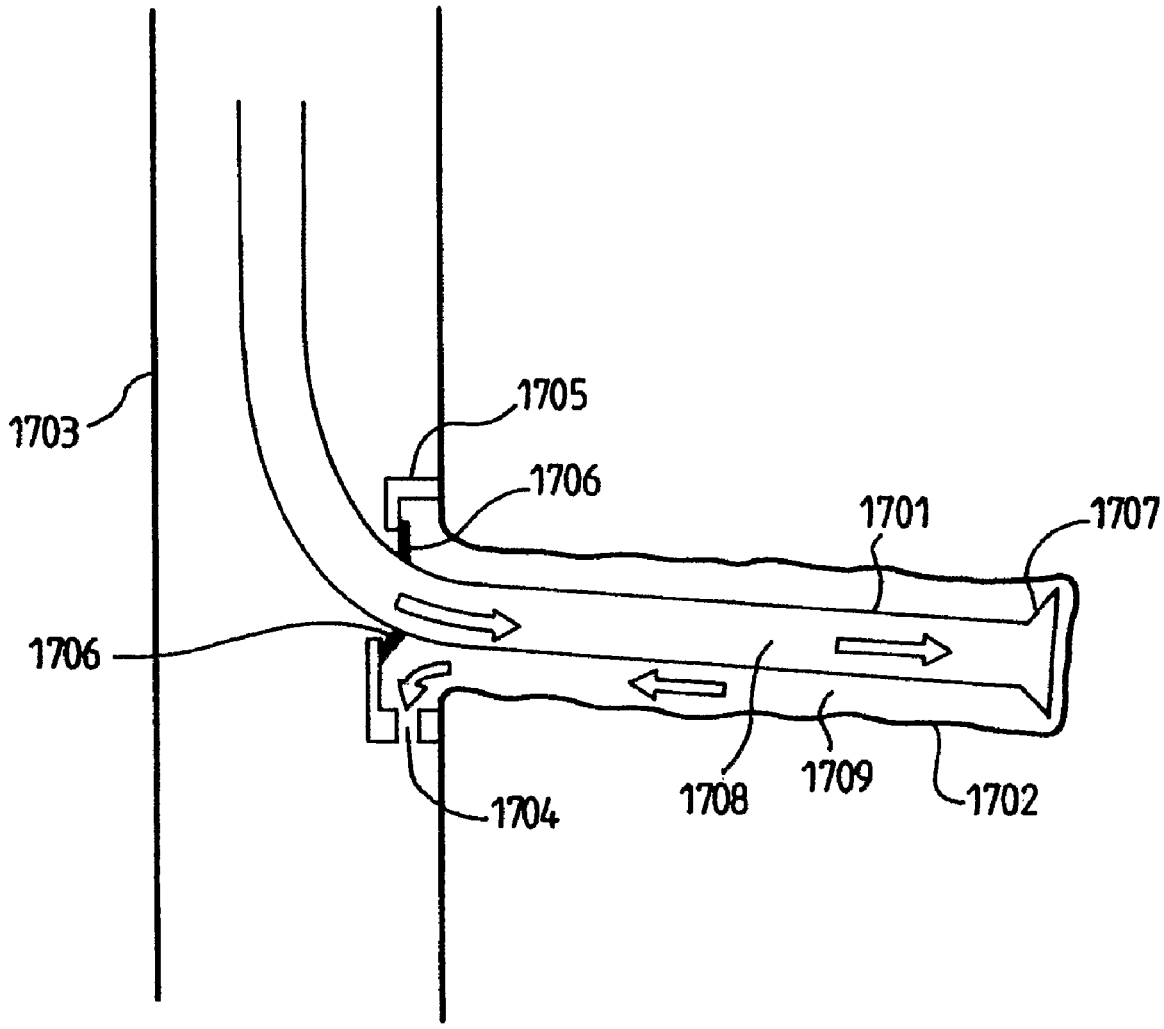
FIG. 17 illustrates an example of a drilling system according to a seventh embodiment of the present invention.

FIG. 17 illustrates an example of a drilling system according to a seventh embodiment of the present invention. A drilling system comprises a drill string assembly 1701. A drill bit 1707 allows to drill a lateral hole 1702 departing from a main well 1703. A drilling fluid may circulate to the drill bit 1707 through a fluid communication channel 1708 inside the drill string assembly 1701. The drilling fluid is evacuated from the lateral hole 1702 through an annulus 1709 between the drill string assembly 1701 and internal walls of the drilled lateral hole 1702. The drilling fluid is guided at an output of the lateral hole 1702 by a passage 1704 having a predetermined orientation.

A sealing device comprising packers 1705 and seal cups 1706 may be provided at the output of the lateral hole 1702 to force the drilling fluid to circulate through the passage 1704.

The passage allows to control the circulation of the drilling fluid once evacuated from the lateral hole 1702. Typically, the passage 1704 may be oriented downward for a further processing of the drilling fluid downhole. The drilling fluid may indeed contains cuttings generated at the drill bit 1707.

Figure 18:
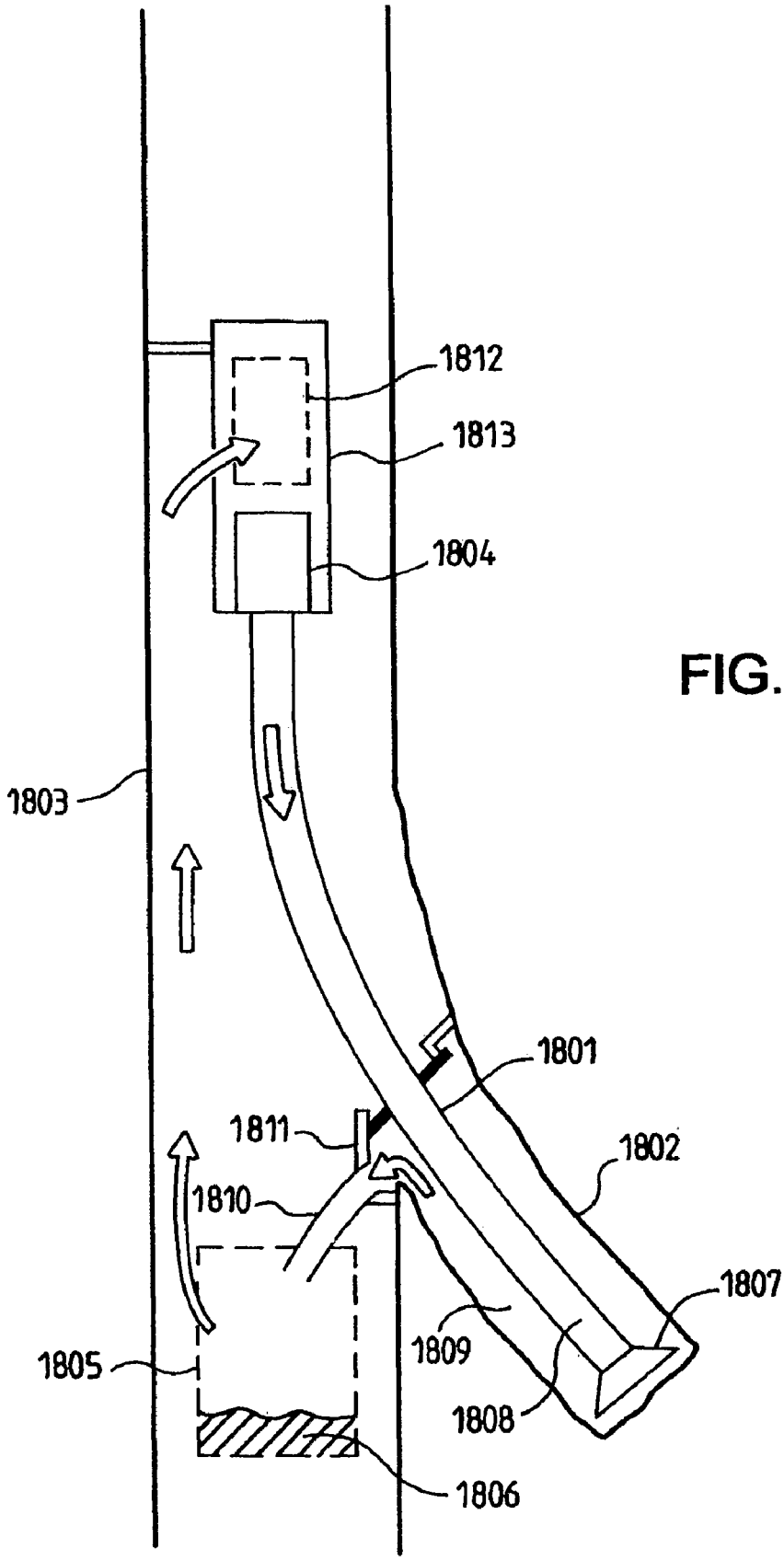
FIG. 18 schematically illustrates an example of a drilling system according to an eighth embodiment of the present invention.

FIG. 18 schematically illustrates an example of a drilling system according to an eighth embodiment of the present invention. A drilling system comprises a drill string assembly 1801. A drill bit 1807 allows to drill a lateral hole 1802 departing from a main well 1803. A drilling fluid may circulate to the drill bit 1807 through a fluid communication channel 1808 inside the drill string assembly 1801. The drilling fluid is evacuated from the lateral hole 1802 through an annulus 1809 between the drill string assembly 1801 and internal walls of the drilled lateral hole 1802. The system further comprises a filter device 1805 for separating cuttings from the drilling fluid.

Preferably, the drilling system may comprise a passage 1810 having a predetermined orientation at an output of the lateral hole 1802, so as to guide the drilling fluid to the filter device 1805. Sealing devices 1811 may be provided so as to force the drilling fluid through the passage 1810.

Alternatively, the drilling system does not comprise any sealing device.

The filter device 1805 allows to separate the cuttings from the drilling fluid. The separated cutting 1806 may be stored within the filter device 1805, and the drilling fluid may be pumped by a pump 1804 located downhole.

The filter device 1805 may be located within the main well, below the lateral hole, as represented in FIG. 18 or at any other downhole location. The filter device may also be located within a drilling machine: in FIG. 18, an optional filter 1812 is located within the drilling machine 1813 that also comprises the pump 1804.

Figure 19:
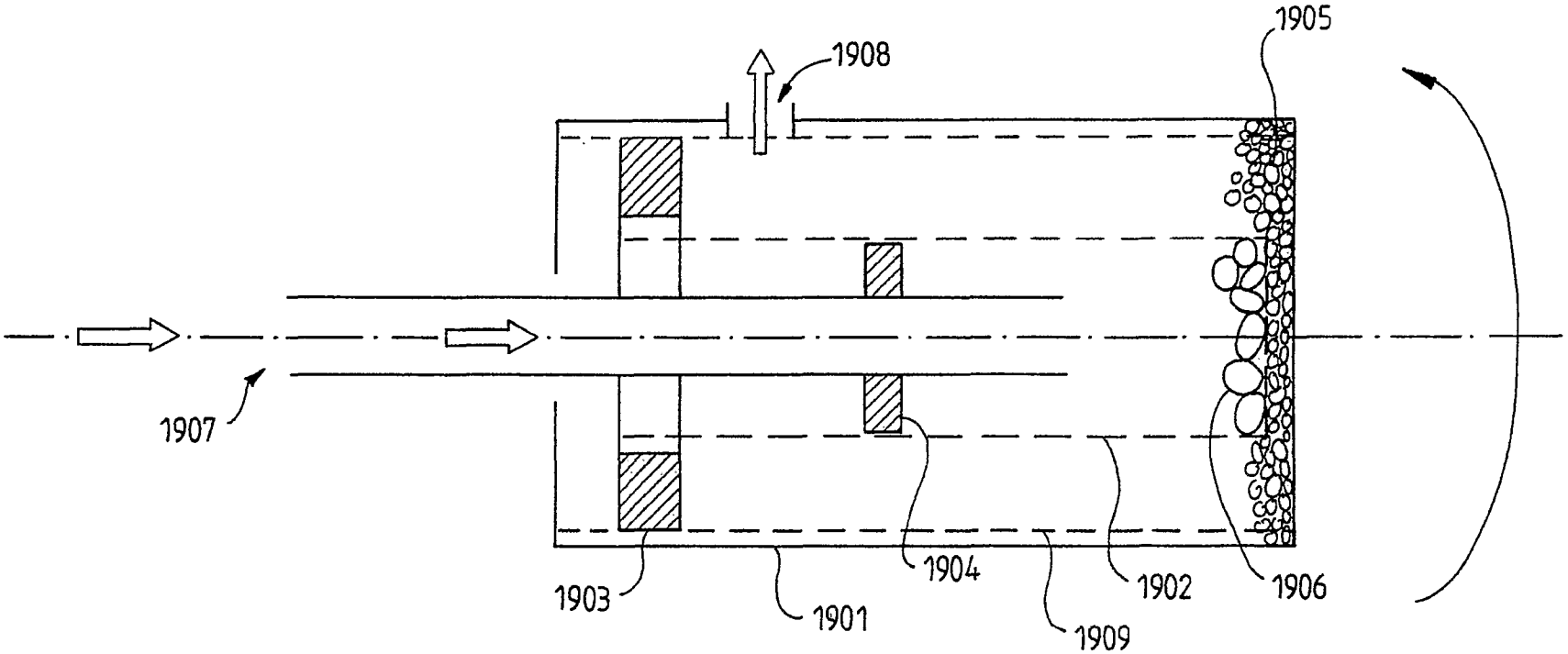
FIG. 19 shows an illustration of an example of filter device according to both a ninth embodiment of the present invention and a tenth embodiment of the present invention.

FIG. 19 illustrates an example of a filter device according to a ninth embodiment of the present invention. The filter device 1901 allows to separate cuttings from a drilling fluid. A compactor (1903, 1904) within the filter device 1901 allows to regularly provide a compaction of the filtered cuttings (1906, 1905).

The compactor (1903; 1904) allows an efficient filling of the filter device 1901. The filter device 1901 hence needs to be replaced less often than a traditional filter device, which is particularly useful if the filter device 1901 is located downhole. Replacing a downhole filter device is indeed time-consuming. Furthermore, in case of a downhole filter device, the filter device may have a longitudinal shape that is well adapted to a shape of a well. The compactor may hence be particularly useful since a natural filling of the cuttings into a longitudinal filter device may not be optimum.

The drilling fluid may enter the filter device 1901 through a filter device input 1907. The separating of the cuttings from the drilling may be provided by centrifugation: the filter device may be rotated around a longitudinal axis.

A filter device according to a tenth embodiment of the present invention allows to separate cuttings from a drilling fluid. FIG. 19 illustrates such a filter device. An adaptive system (1902, 1909) within the filter device 1901 allows to sort the filtered cuttings (1905, 1906) depending on their size so as to avoid the filtered cuttings (1905, 1906) to cork the filter device 1901.

It is indeed well known that particles having a regular size repartition allow to provide an as efficient as possible filling into a determined container. The adaptive system (1902, 1909) according to the present invention allows to avoid such a regular size repartition of the filtered cuttings (1905, 1906) and hence a corking of the filter device 1901. The drilling fluid may thus circulate through the filtered cuttings (1905, 1906) as the filtered cuttings (1905, 1906) are sorted as small cuttings 1905 and large cuttings 1906.

The adaptive system (1902, 1909) may comprise at least one first static filter device 1902. The at least one first static filter device 1902 allows to sort the filtered cuttings (1905, 1906): the large cuttings 1906 are retained in a center of the at least one first static filter device 1902. A second static filter device 1909 allows to prevent the small cutting from escaping from the filter device 1901.

The filter device illustrated in FIG. 19 comprises both the compactor (1903, 1904) and the static filter devices (1902, 1909). The compactor may hence comprise a large cuttings compactor 1904 and a small cuttings compactor 1903. The large cuttings compactor 1904 and the small cuttings compactor 1903 may slide along the longitudinal axis of the filter device 1901.

The filter device 1901 may be located within a main well, whereas the cuttings are generated by a drilling of a lateral hole departing from a main well. The filter device 1901 of the present invention may be a part of a drilling system (not represented on FIG. 19).

The drilling system may comprise a passage at an output of the lateral hole. The passage has a predetermined orientation so as to force the drilling fluid to pass through the filter device 1901.

Preferably, the systems according to the seventh embodiment, eighth embodiment, ninth embodiment and tenth embodiment of the present invention are used with or are part of a drilling system according to the first embodiment of the present invention.

Figure 20:
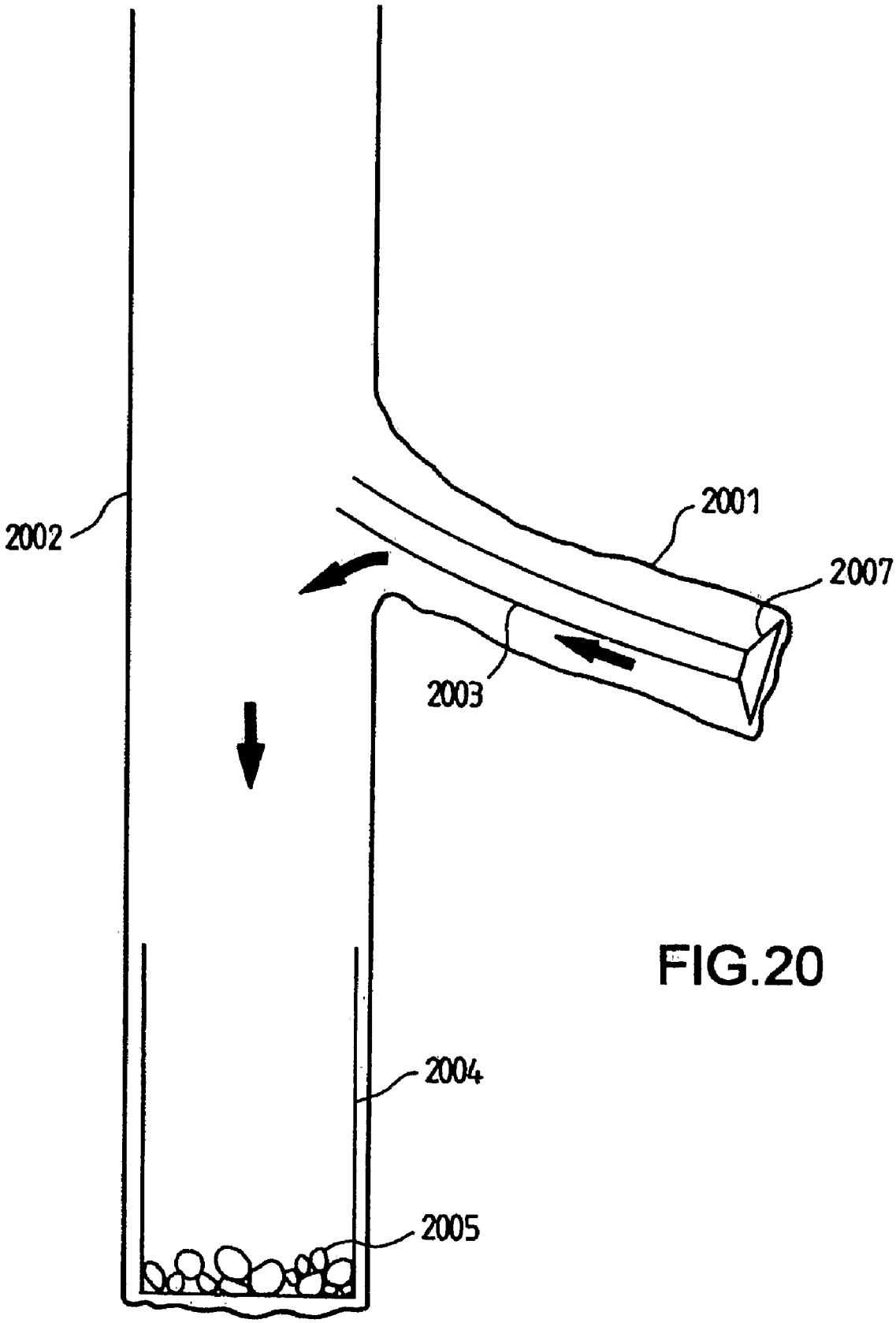
FIG. 20 shows an illustration of an example of a drilling system according to a eleventh embodiment of the present invention.

FIG. 20 illustrates an example of a drilling system according to a eleventh embodiment of the present invention. The drilling system comprises a drill string 2003 and a drill bit 2007 to drill a lateral hole 2001 departing from a main well 2002. The drilling generates cuttings at the drill bit 2007. The cuttings are evacuated out of the lateral hole 2001. A container 2005 located within the main well allows to collect the cuttings below the lateral hole.

During a drilling of the lateral hole, the cuttings, when evacuated from the lateral hole, may be abandoned within the main well. Because of their weight, the cuttings may sediment in the main well. The container 2004 allows to collect the abandoned cuttings. The black arrows of the figure represent a circulation of the cuttings.

The container 2005 may have a long cylindrical shape so as to be adapted to a shape of the main well, or to a shape of a component of the main well, e.g. a casing.

The container may be a filter device according to the ninth embodiment of the present invention. The cuttings drop from the lateral hole into the filter device.

The container may also be a static filter device that sorts the cuttings from a flow of drilling fluid that passes through the static filter device.

The container may comprise a cutting collector unit (not represented on FIG. 20) to insure an efficient filling of the container by the cuttings.

Figure 21A:
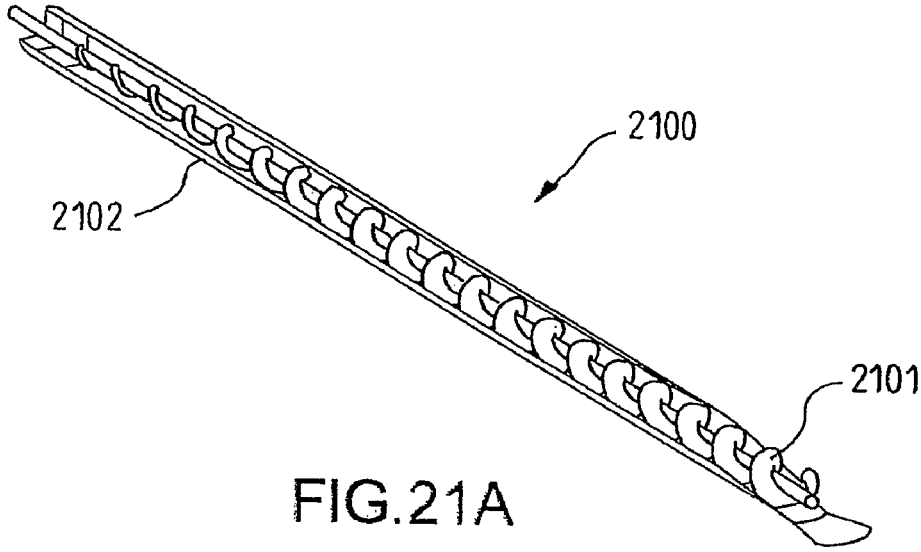
FIG. 21A shows an illustration of an example of a cuttings collector unit according to a twelfth embodiment of the present invention.

FIG. 21A illustrates an example of a cuttings collector unit according to a twelfth embodiment of the present invention. The cuttings collector unit 2100 comprises a compacting unit 2101 having a shape of a long screw which rotates to pull cuttings into a housing 2102. The cuttings collector unit 2100 is typically used for cleaning by scarping cuttings out of a well after a sedimentation of the cuttings. In a typical operation, the screw rotates slowly so as to pull slowly the cuttings and avoid to dilute the cuttings.

The cuttings collector unit 2100 may be used after a drilling operation. The cuttings collector unit 2100 is typically attached to a drilling machine. The housing 2102 may be fixed to a non-rotating connection, e.g. an outside part of a first connector, of the drilling system, so that the drilling machine may push the cuttings collector unit. The screw may be attached to a rotatable portion of the drilling machine, e.g. an inner part of the first connector.

The cutting collector unit 2100 has a longitudinal shape so as to pass through a tubing of the well. The cutting collector unit 2100 allows to collect the cuttings, wherein the cuttings are sedimented in a container, as represented in FIG. 20. The cuttings may alternatively lay directly at a bottom of the well.

The screw may have a conical shape near a top of the housing 2102 so as to insure a proper compacting without blocking the rotation of the screw when a top section of the housing 2102 is full of cuttings.

Figure 21B:
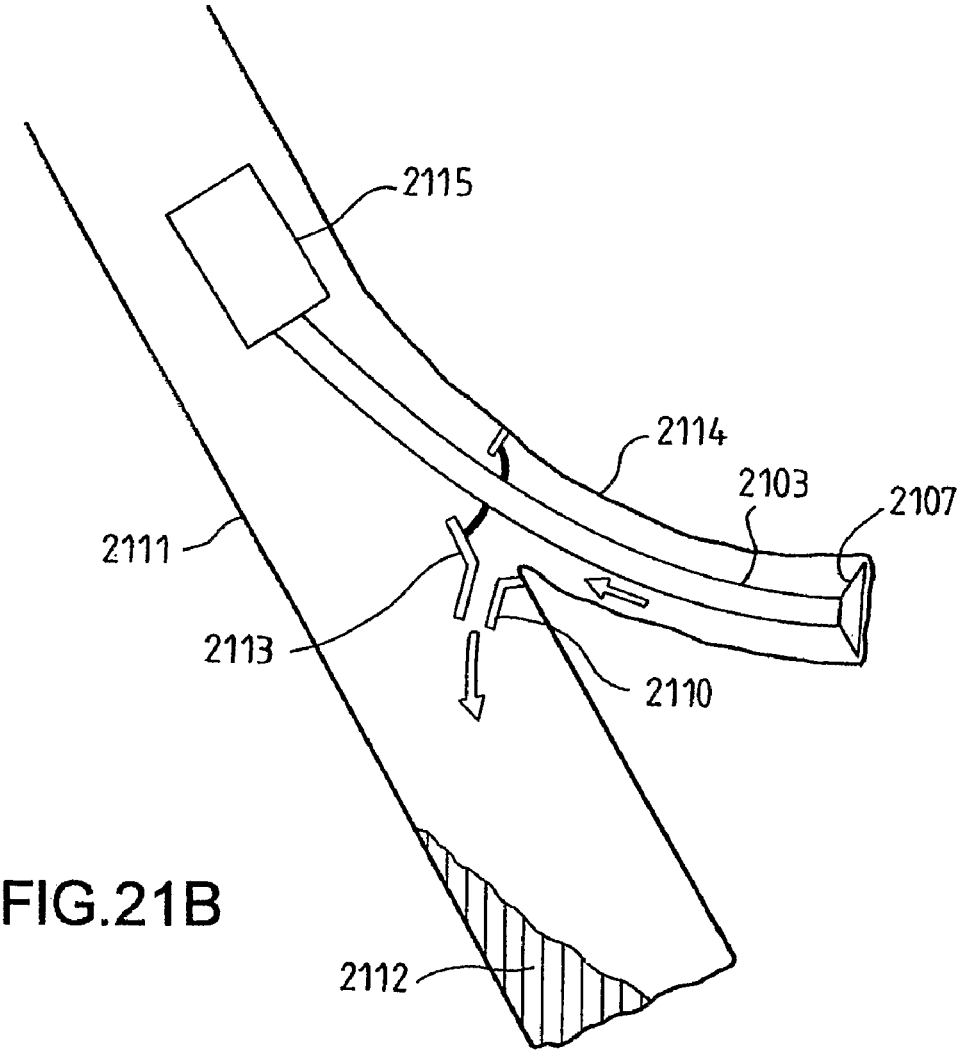
FIG. 21B illustrates an example of a drilling system according to the twelfth embodiment of the present invention.

FIG. 21B illustrates an example of a drilling system according to the twelfth embodiment of the present invention. The drilling system comprises a drilling machine 2115, a drill string 2103 and a drill bit 2107 to drill a lateral hole 2114 departing from a main well 2111. The drilling generates cuttings at the drill bit 2107. The cuttings are carried out of the lateral hole 2114 by a drilling fluid. A sealing device 2113 at an output of the lateral hole 2114 forces the drilling fluid to circulate downward through a passage 2110. The cuttings sediment in the main well 2111 and form a cuttings beds 2112. If the main well 2111 is inclined, as represented in FIG. 21B, the cuttings bed 2112 may lay on a side of the main well 2111.

The drilling machine 2115, the drill string 2103, the drill bit 2107, the sealing device 2113 and the passage 2110 may be removed out of the main well 2111 after the drilling. A cuttings collecting unit (not represented in FIG. 21B) may subsequently be attached to the drilling machine 2115. The drilling machine 2151 and the attached cuttings collecting unit may be lowered in the main well 2111.

The cuttings collecting unit comprises a compacting unit having a shape of a screw, as represented in FIG. 21A. The compacting unit is rotated slowly so as scrap the sedimented cuttings of the cuttings bed 2112 out of the main well 2111.

Preferably, the drilling system according to the twelfth embodiment comprises features of the first embodiment of the present invention, or features of any other embodiment of the present invention.

Figure 22:
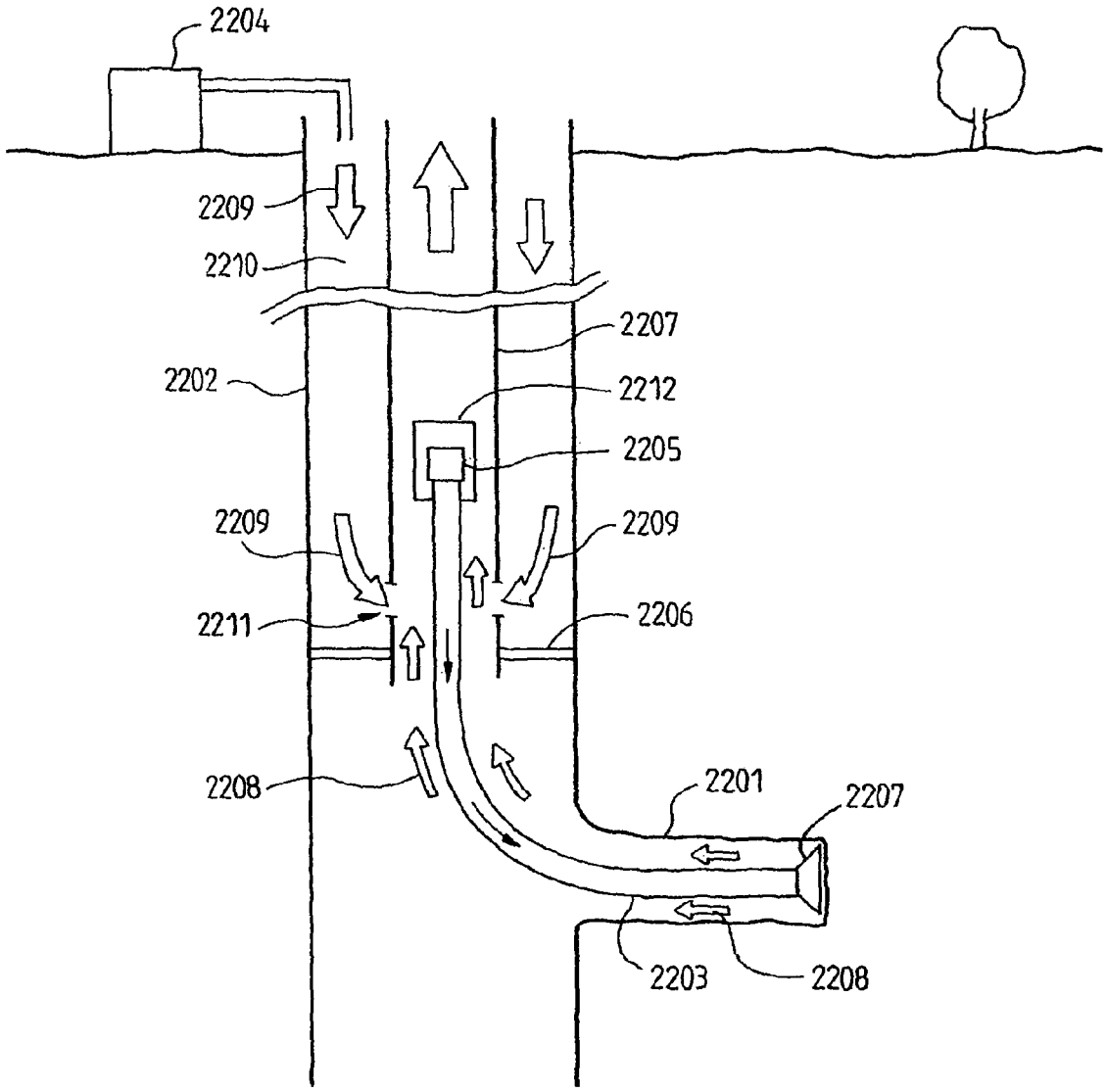
FIG. 22 shows an illustration of an example of a flow circulation system according to a thirteenth embodiment of the present invention.

FIG. 22 illustrates an example of a flow circulation system according to a thirteenth embodiment of the present invention. A drill bit 2207 at an end of a drill string 2203 allows to drill a lateral hole 2201 departing from a main well 2202. A drilling machine 2212 located downhole comprises a pump 2205. The pump 2205 generates a primary circulation flow (represented by the arrows 2208). The primary circulation flow allows to carry cuttings generated at the drill bit 2207 to the drilling machine 2212. A surface pump 2204 allows to generate a secondary circulation flow (represented by the arrows 2209) in a well annulus 2210 between a tubing 2207 and the main well 2201. The secondary circulation flow allows to carry to the surface the cuttings carried by the primary circulation flow.

The flow circulation system according to the present invention allows to carry a drilling fluid with the cuttings at surface. The processing of the drilling fluid at surface is well known from prior art.

The surface pump 2204 delivers a surface fluid into the well annulus 2210. Packers 2206 may block the annulus at a bottom end of the tubing 2207. The delivered surface fluid hence escapes the well annulus 2210 through sliding door valves 2211. The surface fluid from the secondary circulation flow may flow upward in the tubing 2207.

A large portion of the cuttings carried by the primary circulation flow are lifted by the secondary communication flow toward the surface for further processing.

The pump 2205 and other drilling tools (not represented) such as a motor may be located in the tubing 2207, near the sliding door valves 2211. Preferably the pump 2205 is located above the sliding door valve so as to insure a good mixing of the primary circulation flow and the secondary circulation flow. Alternatively, a hollow member (not represented on FIG. 22) may extend the primary flow circulation up to the sliding door valves.

The sliding door valves require to be opened before starting the generating of the secondary circulation flow, which is typically performed by a slick-line operation.

The surface fluid may be a drilling mud, a completion fluid, a cleaned fluid, or a fluid having another composition. The surface fluid may have a same composition as the drilling fluid.

The primary circulation flow insures a transportation of the cuttings from the drill bit 2207 to the sliding door valves so as to insure a further lifting of the cuttings by the secondary circulation flow. However, the main well 2202 has a section that is usually much greater than a section of the lateral hole 2201. A velocity of the primary circulation flow through the main well 2202 is hence much smaller than a velocity of the primary circulation flow through the lateral hole 2201. There is a risk that the transported cuttings drop within the main well 2202 due to a gravity effect.

Figure 23:
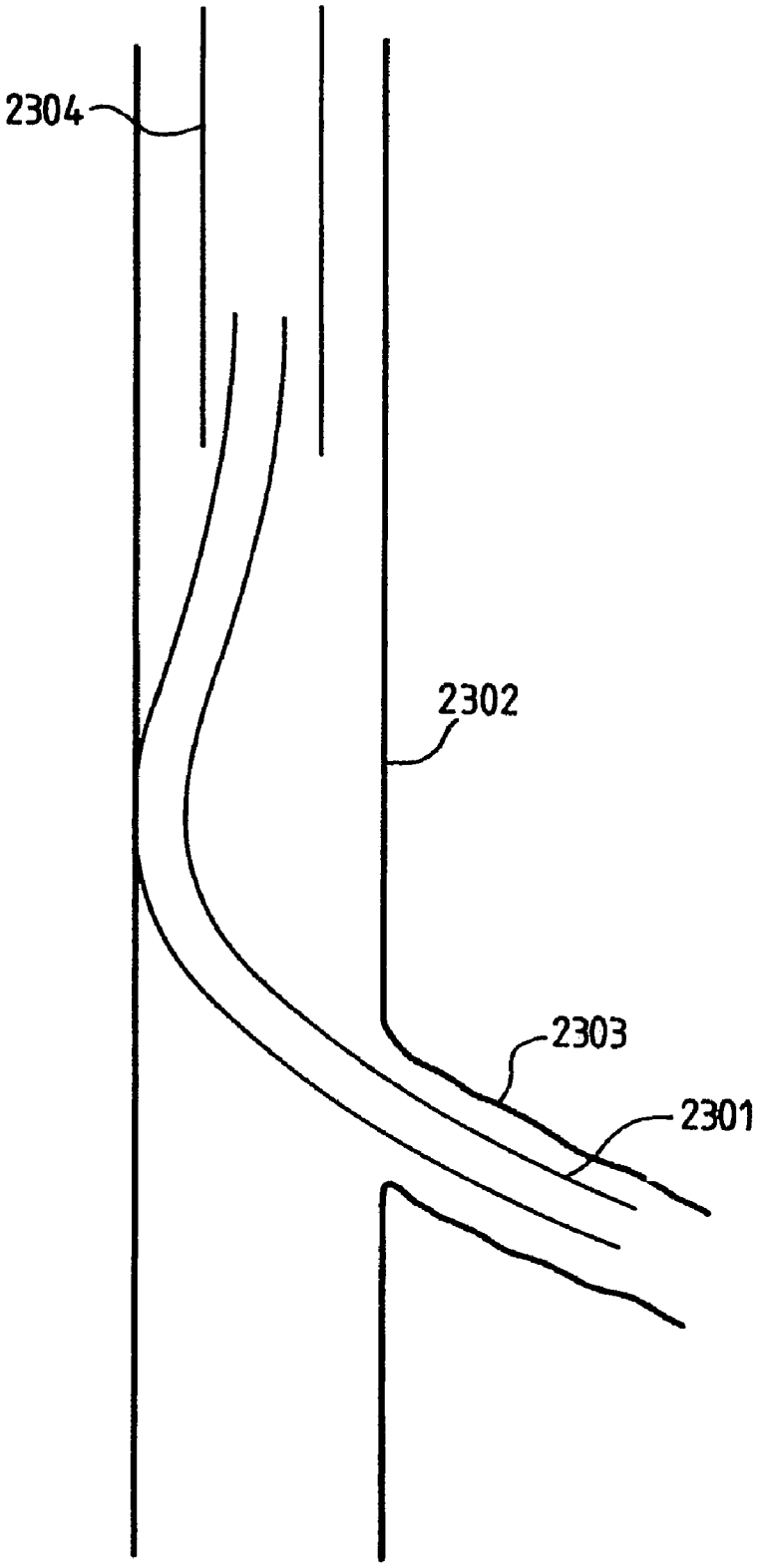
FIG. 23 shows an illustration of an example of a flow guide according to a fourteenth embodiment of the present invention.

FIG. 23 illustrates an example of a flow guide according to a fourteenth embodiment of the present invention. The flow guide 2301 allows a primary circulation flow to circulate at a relatively high velocity between a lateral hole 2303 and a tubing 2304 so as to avoid a sedimentation of cuttings. The cuttings are generated at a drill bit of a drilling system (not represented).

The flow guide 2301 may extend into the lateral hole 2303 to insure that a drilling fluid is forced to circulate through the flow guide. The flow guide may be supported by a whipstock (not represented), or any other support system. A drill string of the drilling system may pass through the flow guide 2301. The flow guide 2301 may be pushed to a casing of the main well 2302 so as to limit a side deformation due to a buckling effect of the drill string.

The flow guide may also be sealed at an end, e.g. an output of the lateral, by a packer device.

The cuttings may be carried by the primary circulation flow to sliding door valves for further lifting up to the surface by a secondary circulation flow. The secondary circulation flow may be generated by a surface pump located at the surface, as described above.

The flow guide may be used within the flow circulation system according to the present invention. Both the flow guide and the flow circulation system may be used in combination with a drilling system for drilling a lateral hole departing from a main well.

Preferably, the drilling system according to the fourteenth embodiment comprises features of the first embodiment of the present invention, or features of any other embodiment of the present invention.

By "drilling fluid", we mean any fluid circulating downhole and allowing a transportation of cuttings. The drilling fluid may contain cuttings. The drilling fluid may also be cleaned.

While the invention has been described with respect to a limited number of embodiments, those skilled in the art, having benefit of this disclosure, will appreciate that other embodiments can be devised which do not depart from the scope of the invention as disclosed herein. Those skilled in the art will also appreciate that the described embodiments may be combined with each other.

Accordingly, the scope of the invention should be limited only by the attached claims.

The invention claimed is:

1. A system for drilling a lateral hole departing from a main well, the system comprising:

a motor assembly including:

a motor to generate a rotating torque;

an axial thruster to generate an axial force;

a blocking system to fix the motor and the axial thruster downhole;

a drive shaft to transmit the rotating torque; and a connector for transmitting the rotating torque and the axial force from the motor assembly to a drill string assembly, the drill string assembly comprising a drill pipe and a drill bit, the connector providing a fluid communication channel between the motor assembly and an inside of the drill pipe; wherein the connector is one of a first connector or a second connector, the first connector being connectable to the drill string assembly so as to transmit the axial force only to the drill pipe, and to transmit the rotating torque to a further drive shaft positioned within the drill pipe, and the second connector being connectable to the drill string assembly so as to transmit both the axial force and the rotating torque to the drill pipe.

2. The system of claim 1 wherein the motor is located within the main well.

3. The system of claim 2, further comprising:

the drill string assembly, the drill string assembly being connected to the connector, the drill string assembly comprising the drill pipe to transmit the axial force; and the further drive shaft to transmit the rotating torque, the further drive shaft being positioned within the drill pipe;

the drill bit.

4. The system of claim 3 wherein:

a portion of the lateral hole comprises a curved hole having a determined radius of curvature;

the drill string assembly comprises three contact points to be in contact with a wall of the drilled lateral hole, the three contact points defining a drill pipe angle so as to allow to drill the curved hole.

5. The system of claim 4, further comprising a thrust bearing to transmit the axial force from the drill pipe to the drill bit, the drill bit being located at an end of the further drive shaft;

a plain bearing system to support a flexion of the further drive shaft within the drill pipe.

6. The system of claim 5, wherein the motor is electrical.

7. The system of claim 2, further comprising:

the drill string assembly, the drill string assembly being connected to the connector, the drill string assembly comprising the drill pipe to transmit both the axial force and the rotating torque;

the drill bit.

8. The system of claim 1, further comprising:

at least one variable diameter stabilizer to position the drill bit within a section of the lateral hole;

controlling means to mechanically control from a remote location at least one stabilizer parameter among a set of stabilizer parameters, the set of stabilizer parameters comprising a diameter size of a determined variable diameter stabilizer, a distance between a first stabilizer and a mark device inside the lateral hole, the mark device being any one of a distinct stabilizer or a drill bit, a coordinated reacting of at least two variable diameter stabilizers, and a azimuthal radius of the determined variable diameter stabilizer.

9. The system of claim 8, further comprising a single control unit to control at least one stabilizer parameter among the set of stabilizer parameters.

10. The system of claim 9, the system comprising:

a configuration slot;

a configuration plot that may be displaced by the controlling means, the configuration plot allowing to select among a set of setting positions a desired setting position;

wherein:

the set of setting positions comprises at least three setting positions;

each setting position corresponds to a determined value of the at least one stabilizer parameter.

11. The system of claim 10, the system comprising two variable diameter stabilizers, wherein the two variable diameter stabilizers may be set in a coordinated fashion.

12. The system of claim 11, further comprising a Hall Effect sensor to measure a diameter of one of the two variable diameter stabilizers.

13. The system according to claim 1, the system further comprising at least one micro-sensor in a close neighborhood of the drill bit, the at least one micro-sensor allowing a measurement of an orientation of the drill bit relative to a reference direction.

14. The system of claim 1, wherein the drill pipe is flexible, so as to allow a bending while transmitting the rotating torque and the axial force;

the system further comprises;

a bending guide with rotating supports to support the drill pipe at the bend.

15. The system of claim 14, wherein:

the rotating supports are belts being supported by a pulley.

16. The system of claim 2, further comprising:

a pump located downhole to pump a drilling fluid.

17. The system of claim 16 where:

the drilling fluid may circulate from the mail well to the drill bit through an annulus between the drilled lateral hole and the drill string assembly;

the drilling fluid may circulate from the drill bit to the main well through the fluid communication channel.

18. The system of claim 17, wherein:

the drill bit comprises a bit hole allowing to evacuate cuttings generated at the drill bit through the drill bit, the drill bit comprises a main blade to insure a cutting action.

19. The system of claim 16, further comprising:

a passage located at an output of the lateral hole, the passage allowing to guide flow of drilling fluid from the lateral hole in the main well.

20. The system of claim 19, further comprising:

a sealing device to force the drilling fluid to circulate through the passage.

21. The system of claim 19 or to claim 20, where the passage is orientated downward.

22. The system of claim 16, further comprising:

a filter device for separating cuttings from the drilling fluid, the filter device being located downhole.

23. The system of claim 22, further comprising:

a compactor within the filter device to regularly provide a compaction of the filtered cuttings.

24. The system of claim 22, further comprising:

an adaptive system within the filter device to sort the filtered cutting depending on their size so as to avoid the filtered cuttings to cork the filter device.

25. The system of claim 16, further comprising:

a container within the main well to collect cuttings below the lateral hole.

26. The system of claim 16, further comprising:

a cuttings collector unit comprising an housing and a screw to pull the cuttings into the housing.

27. The system according to claim 16, further comprising:

a surface pump to generate a secondary circulation flow along a tubing, the secondary circulation flow allowing to carry to the surface cuttings generated at the drill bit and carried by a primary circulation flow from the drill bit to the secondary circulation flow.

28. The system according to claim 26, further comprising:

a flow guide allowing the primary circulation flow to circulate at a relatively high flow velocity between the lateral hole and the tubing so as to avoid a sedimentation of the cuttings.

29. The system of claim 1, wherein the motor is located within the drilled lateral hole.

30. A method for drilling a lateral hole departing from a main well, the method comprising:

blocking a motor and an axial thruster downhole, the motor and the axial thrusters respectively allowing to generate a rotating torque and an axial force;

providing a connector for transmitting the rotating torque and the axial force from a motor assembly to a drill string assembly, the motor assembly including the motor, the axial thruster and a drive shaft, the drill string assembly including a drill pipe and a drill bit;

wherein:

the connector provides a fluid communication channel between the motor assembly and the inside of the drill pipe;

the connector is either one of the first connector or a second connector the first connector being connectable to the drill string assembly so as to transmit the axial force only to the drill pipe, and to transmit the rotating torque to a further drive shaft positioned within the drill pipe, and the second connector being connectable to the drill string assembly so as to transmit both the axial force and the rotating torque to the drill pipe.

31. The method according to claim 30, wherein the motor is located within the mail well.

32. The method of claim 31, wherein the drill pipe transmits the axial force, and the further drive shaft transmits the rotating torque to the drill bit.

33. The method of claim 32, further comprising controlling an effective radius of a curved hole of the lateral hole, the controlling being performed by combining an angled mode to a straight mode wherein;

during the angled mode, three contacts points of the drill string assembly are in contact with a wall of the drilled lateral hole so as to allow to drill the curved hole; and during the straight mode, the following steps are performed;

rotating the drill pipe of a first angle;

transmitting the rotating torque and the axial force to the drill bit for a first determined duration;

pulling the drill string assembly back over a determined distance;

rotating the drill pipe of a second angle;

transmitting the rotating torque and the axial force to the drill bit for a second determined duration.

34. The method of claim 33, wherein the controlling is performed by combining the angled mode and the straight mode to a jetting mode, the jetting mode comprising:

providing a jet of fluid to preferentially erode a formation in a determined direction.

35. The method of claim 31, wherein the drill pipe transmits both the rotating torque and the axial force to the drill bit.

36. The method according to claim 30, further comprising:

mechanically controlling from a remote location at least one stabilizer parameter among a set of stabilizer parameters, the set of stabilizer parameters comprising a diameter size of a determined variable diameter stabilizer, a distance between a first stabilizer relative to a mark device, the mark device being any one of a distinct stabilizer or a drill bit, a retracting of a least two variable diameter stabilizers, and an azimuthal radius of the determined variable diameter stabilizer.

37. The method according to claim 36, further comprising:

displacing a configuration plot within a configuration slot, so as to select a desired setting position among a set of setting positions comprising at least three setting positions, each setting position corresponding to a determined value of the at least one stabilizer parameter.

38. The method according to claim 30, wherein:

the drill pipe is flexible, so as to allow a bending while transmitting the rotating torque and the axial force;

the drill pipe is supported at the bend by a bending guide comprising rotating supports.

39. The method according to claim 30, the method further comprising monitoring an orientation of the drill bit relative to at least one reference direction with at least one micro sensor located in a close neighborhood of the drill bit.

40. The method according to claim 31, further comprising:

generating a circulation of a drilling fluid to the drill bit with a pump located downhole.

41. The method according to claim 40, wherein:

the drilling fluid circulates to the drill bit through an annulus between the drilled lateral hole and the drill string assembly;

the drilling fluid circulates from the drill bit through the fluid communication channel.

42. The method according to claim 40, the method further comprising guiding the drilling fluid at an output of the lateral hole through a passage having a predetermined orientation.

43. The method according to claim 42, wherein the drilling fluid is guided downward.

44. The method according to claim 40, further comprising downhole filtering cuttings from the drilling fluid.

45. The method according to claim 44, further comprising compacting the filtered cuttings inside a filter device.

46. The method according to claim 44, further comprising sorting the filtered cuttings according to their size so as to avoid the filtered cuttings to cork the filter device.

47. The method according to claim 40, further comprising collecting cuttings downhole at a location below the lateral hole.

48. The method according to claim 40, further comprising: generating a secondary circulation flow along a tubing, the secondary circulation flow allowing to carry to the surface cuttings generated at the drill bit and carried by a primary circulation flow from the drill bit to the secondary circulation flow.

49. The method of claim 30, wherein the motor is located within the drilled lateral hole.

* * * * *